US011439887B2

(12) United States Patent
Lagree et al.

(10) Patent No.: US 11,439,887 B2
(45) Date of Patent: Sep. 13, 2022

(54) EXERCISE MACHINE WITH VISUAL GUIDANCE

(71) Applicant: Lagree Technologies, Inc., Chatsworth, CA (US)

(72) Inventors: Sebastien Anthony Louis Lagree, Chatsworth, CA (US); John C. Hamilton, Santa Clarita, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 102 days.

(21) Appl. No.: 17/005,570

(22) Filed: Aug. 28, 2020

(65) Prior Publication Data

US 2021/0069572 A1 Mar. 11, 2021

Related U.S. Application Data

(60) Provisional application No. 62/897,440, filed on Sep. 9, 2019.

(51) Int. Cl.
*A63B 71/06* (2006.01)

(52) U.S. Cl.
CPC .. *A63B 71/0622* (2013.01); *A63B 2071/0658* (2013.01); *A63B 2220/30* (2013.01)

(58) Field of Classification Search
None
See application file for complete search history.

(56) References Cited

U.S. PATENT DOCUMENTS

| | | | |
|---|---|---|---|
| 1,621,477 | A | 8/1925 | Pilates |
| 2,894,755 | A | 7/1959 | Scetzo, Jr. |
| 3,730,531 | A | 5/1973 | Zega |
| 3,770,267 | A | 11/1973 | McCarthy |
| 4,013,068 | A | 3/1977 | Settle |
| 4,437,669 | A | 3/1984 | Pelz |
| 4,506,884 | A | 3/1985 | Hankin |
| 4,759,540 | A | 7/1988 | Yu |
| 4,798,378 | A | 1/1989 | Jones |
| 5,066,005 | A | 11/1991 | Luecke |
| 5,201,694 | A | 4/1993 | Zappel |
| 5,263,913 | A | 11/1993 | Boren |
| 5,365,934 | A | 11/1994 | Leon |
| 5,429,565 | A | 7/1995 | Hagg |

(Continued)

FOREIGN PATENT DOCUMENTS

| | | | |
|---|---|---|---|
| WO | 2004/096376 | A1 | 11/2004 |
| WO | 2014/084742 | A1 | 6/2014 |

OTHER PUBLICATIONS http://www.brainproducts.com/productdetails.php?id=63&tab=1; LiveAmp Overview; Jun. 14, 2016.

(Continued)

*Primary Examiner* — Sundhara M Ganesan
*Assistant Examiner* — Shila Jalalzadeh Abyaneh
(74) *Attorney, Agent, or Firm* — Neustel Law Offices

(57) ABSTRACT

An exercise machine with visual guidance for providing an instructional lighting system for use with an exercise machine. The exercise machine with visual guidance generally provides for a novel exercise machine comprising an exercise platform movable substantially the length of one or more longitudinal rails, and a lighting system to instruct the exerciser on such exercise elements that may include the direction, pace or intensity of the exercise.

20 Claims, 14 Drawing Sheets

(56) References Cited

U.S. PATENT DOCUMENTS

D362,700 S 9/1995 Breibart
5,527,041 A 6/1996 Terry, III
5,584,783 A 12/1996 Hagg
5,586,941 A 12/1996 Klearman
D382,319 S 8/1997 Gerschefske
5,681,249 A 10/1997 Endelman
5,738,104 A 4/1998 Lo
5,812,978 A 9/1998 Nolan
5,885,197 A 3/1999 Barton
5,967,955 A 10/1999 Westfall
6,152,856 A 11/2000 Studor
6,179,753 B1 1/2001 Barker
7,108,635 B2 9/2006 Howlett-Campanella
7,163,500 B2 1/2007 Endelman
7,192,387 B2 3/2007 Mendel
7,448,986 B1 11/2008 Porth
7,537,554 B2 5/2009 Zhuang
7,803,095 B1 9/2010 Lagree
7,914,420 B2 3/2011 Daly
7,931,570 B2 4/2011 Hoffman
7,967,728 B2 6/2011 Zavadsky
8,021,242 B1 9/2011 Tennison
8,287,434 B2 10/2012 Zavadsky
8,303,470 B2 11/2012 Stewart
8,641,585 B2 2/2014 Lagree
8,740,758 B2 6/2014 Sandvig
8,812,075 B2 8/2014 Nguyen
8,852,062 B2 10/2014 Dorsay
8,911,328 B2 12/2014 Alessandri
9,011,291 B2 4/2015 Birrell
9,089,759 B1 7/2015 Moschillo
9,199,123 B2 12/2015 Solow
9,227,124 B1 1/2016 Sparks
9,480,876 B1 11/2016 Blacklock
9,808,662 B1 11/2017 File
10,220,244 B2 3/2019 Lagree
10,272,317 B2 * 4/2019 Watterson ..... A63B 71/0686
2001/0056011 A1 12/2001 Endelman
2002/0137607 A1 9/2002 Endelman
2003/0119635 A1 6/2003 Arbuckle
2004/0160199 A1 * 8/2004 Morgan ..... G09G 3/14
315/312
2005/0164856 A1 7/2005 Parmater
2006/0046914 A1 3/2006 Endelman
2006/0183606 A1 8/2006 Parmater
2006/0199712 A1 9/2006 Barnard
2006/0223681 A1 10/2006 Loane
2007/0202992 A1 8/2007 Grasshoff
2007/0224582 A1 9/2007 Hayashino
2007/0270293 A1 11/2007 Zhuang
2008/0051256 A1 2/2008 Ashby
2008/0058174 A1 3/2008 Barnard
2008/0070765 A1 3/2008 Brown
2008/0139975 A1 6/2008 Einav
2008/0242519 A1 10/2008 Parmater
2008/0248935 A1 10/2008 Solow
2009/0005698 A1 1/2009 Lin
2009/0291805 A1 11/2009 Blum
2009/0312152 A1 12/2009 Kord
2010/0125026 A1 5/2010 Zavadsky
2010/0160092 A1 * 6/2010 Oneschuk ..... A63B 69/0024
473/436
2010/0227748 A1 9/2010 Campanaro
2010/0267524 A1 10/2010 Stewart
2011/0018233 A1 1/2011 Senner
2011/0077127 A1 3/2011 Ishii
2011/0143898 A1 6/2011 Trees
2011/0152045 A1 6/2011 Home
2011/0166002 A1 7/2011 Savsek
2011/0172069 A1 7/2011 Gerschefske
2011/0184559 A1 7/2011 Benabid
2011/0275447 A1 11/2011 Jasinski
2011/0275482 A1 * 11/2011 Brodess ..... A63B 21/4035
482/8
2012/0015334 A1 1/2012 Hamilton
2012/0088634 A1 4/2012 Heidecke
2012/0088641 A1 4/2012 Shah
2012/0143020 A1 6/2012 Bordoley
2012/0202656 A1 6/2012 Dorsay
2012/0190505 A1 7/2012 Shavit
2012/0228385 A1 9/2012 DeLuca
2012/0283078 A1 11/2012 Solow
2012/0295722 A1 11/2012 Vancho
2012/0295771 A1 11/2012 Lagree
2013/0072353 A1 3/2013 Alessandri
2013/0102406 A1 4/2013 Yu
2013/0196835 A1 8/2013 Solow
2013/0210578 A1 8/2013 Birrell
2013/0289889 A1 10/2013 Yuen
2014/0005007 A1 1/2014 Ho
2014/0011645 A1 1/2014 Johnson
2014/0024508 A1 1/2014 Hinds
2014/0066257 A1 3/2014 Shavit
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 5/2014 Aronson
2014/0148715 A1 5/2014 Alexander
2014/0155187 A1 6/2014 Spelman
2014/0179492 A1 * 6/2014 Wilkins ..... A63B 71/0619
482/27
2014/0213415 A1 7/2014 Parker
2015/0012111 A1 1/2015 Contreras-Vidal
2015/0024914 A1 1/2015 Lagree
2015/0057127 A1 2/2015 Lagree
2015/0065318 A1 3/2015 Lagree
2015/0072841 A1 3/2015 Lagree
2015/0093732 A1 4/2015 Ross
2015/0105223 A1 4/2015 Bissu
2015/0111706 A1 4/2015 Broadhurst
2015/0141204 A1 5/2015 Lagree
2015/0217164 A1 8/2015 Lagree
2015/0220523 A1 8/2015 Lagree
2015/0246263 A1 9/2015 Campanaro
2015/0262459 A1 * 9/2015 Munro ..... A63B 24/0087
340/522
2015/0297944 A1 10/2015 Lagree
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0364059 A1 12/2015 Marks
2015/0367162 A1 12/2015 Mueller
2015/0367166 A1 12/2015 Lagree
2016/0008657 A1 1/2016 Lagree
2016/0059060 A1 3/2016 Lagree
2016/0059061 A1 3/2016 Lagree
2016/0096059 A1 4/2016 Lagree
2016/0109218 A1 4/2016 Austin
2016/0166870 A1 6/2016 Lagree
2016/0193496 A1 7/2016 Lagree
2016/0256733 A1 9/2016 Lagree
2016/0271452 A1 * 9/2016 Lagree ..... G16H 20/30
2016/0317858 A1 11/2016 Lagree
2016/0346593 A1 12/2016 Lagree
2016/0361602 A1 12/2016 Lagree
2017/0014664 A1 1/2017 Lagree
2017/0014672 A1 1/2017 Lagree
2017/0036057 A1 2/2017 Lagree
2017/0036061 A1 2/2017 Lagree
2017/0043210 A9 2/2017 Lagree
2017/0065846 A1 3/2017 Lagree
2017/0072252 A1 3/2017 Lagree
2017/0087397 A1 3/2017 Lagree
2017/0100625 A1 4/2017 Lagree
2017/0100629 A1 4/2017 Lagree
2017/0106232 A1 4/2017 Lagree
2017/0113091 A1 4/2017 Lagree
2017/0120101 A1 5/2017 Lagree
2017/0144013 A1 5/2017 Lagree
2017/0151459 A1 6/2017 Abramovich
2017/0157452 A1 6/2017 Lagree

(56) References Cited

U.S. PATENT DOCUMENTS

| | | | | |
|---|---|---|---|---|
| 2017/0157458 | A1 | 6/2017 | Lagree | |
| 2017/0165518 | A1 | 6/2017 | Lagree | |
| 2017/0165555 | A1 | 6/2017 | Lagree | |
| 2017/0189740 | A1 | 7/2017 | Lagree | |
| 2017/0189741 | A1 | 7/2017 | Lagree | |
| 2017/0209728 | A1 | 7/2017 | Lagree | |
| 2017/0239526 | A1 | 8/2017 | Lagree | |
| 2017/0246491 | A1 | 8/2017 | Lagree | |
| 2017/0246499 | A1 | 8/2017 | Lagree | |
| 2017/0266533 | A1* | 9/2017 | Dalebout | A63B 71/0622 |
| 2017/0296865 | A1 | 10/2017 | Lagree | |
| 2017/0304673 | A1 | 10/2017 | Lagree | |
| 2017/0326406 | A1 | 11/2017 | Lagree | |
| 2017/0340947 | A1* | 11/2017 | Lagree | A63B 22/0089 |
| 2017/0354840 | A1 | 12/2017 | Lagree | |
| 2018/0008877 | A1 | 1/2018 | Haycock | |
| 2018/0015319 | A1 | 1/2018 | Lagree | |
| 2018/0021621 | A1 | 1/2018 | Lagree | |
| 2018/0021655 | A1 | 1/2018 | Lagree | |
| 2018/0036583 | A1 | 2/2018 | Lagree | |
| 2018/0056109 | A1 | 3/2018 | Lagree | |
| 2018/0056133 | A1 | 3/2018 | Lagree | |
| 2018/0111020 | A1 | 4/2018 | Lagree | |
| 2018/0111033 | A1 | 4/2018 | Lagree | |
| 2018/0117392 | A1 | 5/2018 | Lagree | |
| 2018/0133532 | A1 | 5/2018 | Lagree | |
| 2018/0133533 | A1 | 5/2018 | Lagree | |
| 2018/0133534 | A1 | 5/2018 | Lagree | |
| 2018/0133542 | A1 | 5/2018 | Lagree | |
| 2018/0178053 | A1 | 6/2018 | Lagree | |
| 2018/0193691 | A1 | 7/2018 | Lagree | |
| 2018/0250551 | A1 | 9/2018 | Lagree | |
| 2018/0250573 | A1 | 9/2018 | Lagree | |
| 2018/0272179 | A1 | 9/2018 | Lagree | |
| 2018/0280782 | A1 | 10/2018 | Lagree | |
| 2018/0318627 | A1 | 11/2018 | Lagree | |
| 2018/0318646 | A1 | 11/2018 | Lagree | |
| 2018/0326252 | A1 | 11/2018 | Lagree | |
| 2018/0353803 | A1 | 12/2018 | Lagree | |
| 2018/0361190 | A1 | 12/2018 | Lagree | |
| 2018/0361197 | A1 | 12/2018 | Lagree | |
| 2019/0083842 | A1 | 3/2019 | Lagree | |
| 2019/0160320 | A1 | 5/2019 | Lagree | |
| 2019/0160329 | A1 | 5/2019 | Lagree | |
| 2019/0232105 | A1 | 8/2019 | Lagree | |
| 2019/0240530 | A1 | 8/2019 | Lagree | |
| 2019/0247694 | A1 | 8/2019 | Lagree | |
| 2019/0247705 | A1 | 8/2019 | Lagree | |
| 2019/0247707 | A1 | 8/2019 | Lagree | |
| 2019/0255375 | A1 | 8/2019 | Lagree | |
| 2019/0269961 | A1 | 9/2019 | Lagree | |
| 2019/0314672 | A1 | 10/2019 | Lagree | |
| 2019/0358484 | A1 | 11/2019 | Lagree | |
| 2020/0030657 | A1 | 1/2020 | Lagree | |
| 2020/0047051 | A1 | 2/2020 | Lagree | |
| 2020/0054913 | A1 | 2/2020 | Lagree | |
| 2020/0078630 | A1 | 3/2020 | Lagree | |
| 2020/0078634 | A1 | 3/2020 | Lagree | |
| 2020/0171337 | A1 | 6/2020 | Lagree | |

OTHER PUBLICATIONS http://www.cognionics.com/index.php/products/hd-eeg-systems/72-channel-system; Cognionics HD-72 Overview; Jun. 14, 2016.

http://www.cognionics.com/index.php/products/hd-eeg-systems/quick-20-dry-headset; Cognionics Quick-20 Dry EEG Headset; Jun. 14, 2016.

http://www.cognionics.com/index.php/products/hd-eeg-systems/mobile-eeg-cap; Cognionics Mobile-72 Wireless EEG System; Jun. 14, 2016.

http://www.cognionics.com/index.php/products/mini-systems/dry-eeg-headband; Cognionics Dry EEG Headband; Jun. 14, 2016.

http://www.cognionics.com/index.php/products/mini-systems/multi-position-dry-headband; Cognionics Multi-Position Dry EEG Headband; Jun. 14, 2016.

PCT Preliminary Report on Patentability from International Searching Authority for PCT/US2016/022888; dated Sep. 28, 2017.

PCT International Search and Opinion from International Searching Authority for PCT/US2016/022888; dated Jul. 25, 2016.

PCT International Search and Opinion from International Searching Authority for PCT/US2017/041638; dated Sep. 28, 2017.

http://www.puzzlebox.io/brainstorms/; Puzzlebox Brainstorms Website Article; Jun. 13, 2016.

https://www.youtube.com/watch?v=xj2xuGsB3yo; Screenshot of YouTube Video "Iphone Free App (Dec. 16, 2010) Finger Balance"; Tuuske; Dec. 16, 2010.

http://tera.lunar-europe.com; TERA Fitness Mat; Lunar Europe; Jun. 8, 2014.

Picture of Proformer Exercise Machine developed by the inventor, Sebastien Lagree; Dec. 31, 2008.

Drawing of Proformer Exercise Machine Developed by the Inventor, Sebastien Lagree; 2008.

Picture of Proformer Redline Developed by the Inventor, Sebastien Lagree; 2008.

https://www.yelp.com/biz_photos/solidcore-washington-5?select=ywY122p-_3f6JAJ15cXDWg; Picture of Solidcore Modification posted on Yelp website on Dec. 23, 2014.

Picture of Solidcore Machine believed to be from Solidcore's Facebook page; Mar. 4, 2016.

https://www.facebook.com/solidcorestudio/photos/a.147049612160841/478381339027665/?type=3&theater; Picture of Solidcore Machine from Facebook Webpage; Mar. 25, 2016.

https://www.facebook.com/solidcorestudio/photos/a.147049612160841/480088418856957/?type=3&theatre; Picture of Solidcore Machine from Facebook Webpage; Mar. 28, 2016.

* cited by examiner

Visual Guidance Devices On / Bright
Visual Guidance Devices Variable
Visual Guidance Devices Off / Dim Chase individual visual guidance devices, variable X visual guidance devices off between on visual guidance devices
Chase blocks of visual guidance devices, variable off visual guidance device interval between on illuminated blocks
Pulsate all

EXERCISE MACHINE WITH VISUAL GUIDANCE

CROSS REFERENCE TO RELATED APPLICATIONS

I hereby claim benefit under Title 35, United States Code, Section 119(e) of U.S. provisional patent application Ser. No. 62/897,440 filed Sep. 9, 2019. The 62/897,440 application is hereby incorporated by reference into this application.

STATEMENT REGARDING FEDERALLY SPONSORED RESEARCH OR DEVELOPMENT

Not applicable to this application.

BACKGROUND

Field

Example embodiments in general relate to an exercise machine with visual guidance for providing an instructional lighting system for use with an exercise machine.

Related Art

Any discussion of the related art throughout the specification should in no way be considered as an admission that such related art is widely known or forms part of common general knowledge in the field.

There exists a large body of art teaching various configurations of lighting to illuminate exercise machines. However, these lights do not provide a means to instruct exercisers on the direction, pace or intensity they should be exercising, nor whether the direction, pace or intensity should change during the exercise routine.

SUMMARY

An example embodiment is directed to an exercise machine with visual guidance. The exercise machine with visual guidance provides for a novel exercise machine comprising an exercise platform movable substantially the length of one or more longitudinal rails, and a lighting system to instruct the exerciser on such exercise elements that may include the direction, pace or intensity of the exercise.

There has thus been outlined, rather broadly, some of the embodiments of the exercise machine with visual guidance in order that the detailed description thereof may be better understood, and in order that the present contribution to the art may be better appreciated. There are additional embodiments of the exercise machine with visual guidance that will be described hereinafter and that will form the subject matter of the claims appended hereto. In this respect, before explaining at least one embodiment of the exercise machine with visual guidance in detail, it is to be understood that the exercise machine with visual guidance is not limited in its application to the details of construction or to the arrangements of the components set forth in the following description or illustrated in the drawings. The exercise machine with visual guidance is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
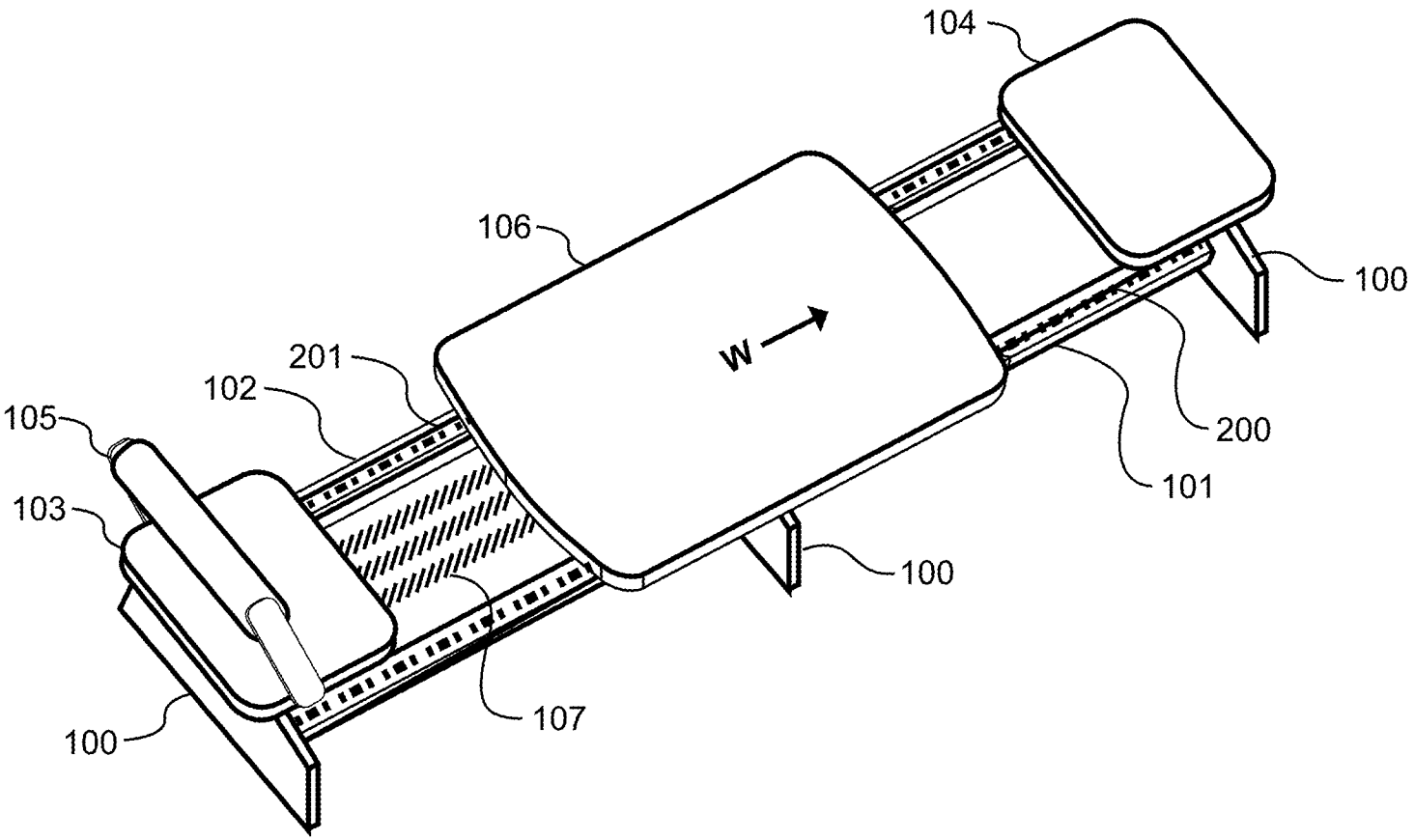
FIG. 1 is an exemplary diagram showing an isometric view of an improved exercise machine.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments.

The term "lights" and/or "lamps" as used herein preferably refers to a plurality of light emitting diodes (LED's) arranged sequentially in a rope configuration with one or more LEDs electronically actuated by means of a single channel controller or multi-channel controller, however one or more lights may comprise incandescent, fluorescent, compact fluorescent, halogen, high intensity discharge (HID), metal halide, or low pressure sodium lamps, or any combination thereof. The preference in the use of LEDs is not meant to be limiting.

The term "biasing member" is used herein to mean an extensible member that produces an increasing force as the length of the member is extended, and may include extension springs, elastomeric rope, or a non-extensible member with one end affixed to a clock spring. The form of a biasing member is therefore not meant to be limiting.

The term "instruction" is used herein to mean a system comprising one or more lights and/or audible sounds that direct an exerciser to perform an exercise in response to the visual or audible instructions that are actuated prior to, during and/or after the performance of an exercise upon an improved exercise machine. The light and/or sound instruction may include the direction an exerciser should move a slidable carriage during performance of an exercise, instructions to increase exercise speed, decrease exercise speed, instructions that induce exerciser motivation, and/or direction indicating the intensity level at which the exercise should be performing during the exercise.

An exemplary embodiment of an exercise machine visual guidance system may comprise one or more visual guidance devices 200, 201, 202, 203, 204, 206 which are affixed to the exercise machine. The visual guidance devices 200, 201, 202, 203, 204, 206 may comprise various types of devices known to provide visual guidance, such as but not limited to lighting devices, illumination devices, lamps, light-emitting-diodes (LED's), liquid crystal displays (LCD's), light ropes, projection devices, holographic generators, linear lighting, visual display, fluorescent lights, rope lights such as but not limited to LED rope lights, light strips such as but not limited to LED light strips, LCD displays, display screens (elongated or non-elongated), a series of lights (e.g., LED, LCD, incandescent, halogen, compact fluorescent lamps (FCL), neon), and the like. The visual guidance devices 200, 201, 202, 203, 204, 206 may be connected together on the same circuit, or different circuits may be utilized for one or more of the visual guidance devices 200, 201, 202, 203, 204, 206.

The type of visual guidance devices 200, 201, 202, 203, 204, 206 may vary in different embodiments. In one exemplary embodiment such as shown in FIGS. 1, 2, 4A, 4B, and 6, the visual guidance devices 200, 201, 202, 203, 204, 206 may comprise a lighting device such as a rope light. In some embodiments where multiple visual guidance devices 200, 201, 202, 203, 204, 206 are utilized, it should be appreciated that different types of visual guidance devices 200, 201, 202, 203, 204, 206 may be mixed together. For example, the exercise machine may include a first visual guidance device 200 comprised of a rope light and a second visual guidance device 201 comprised of an elongated LCD display.

The number of visual guidance devices 200, 201, 202, 203, 204, 206 may also vary in different embodiments. Thus, the exemplary embodiments shown in the figures should not be construed as limiting with regard to how many visual guidance devices 200, 201, 202, 203, 204, 206 are utilized. Similarly, the spacing, arrangement, orientation, and positioning of the visual guidance devices 200, 201, 202, 203, 204, 206 should not be construed as limited by the exemplary embodiments shown in the figures, as the spacing, arrangement, orientation, and positioning of the visual guidance devices 200, 201, 202, 203, 204, 206 may vary in different embodiments to suit different types of exercise machine and the needs of different types of exercisers.

In the exemplary embodiment shown in the figures, the visual guidance devices 200, 201, 202, 203, 204, 206 are illustrated as comprising a left visual guidance device 200, a right visual guidance device 201, an under structure visual guidance device 202, a front visual guidance device 203, and a back visual guidance device 204. The left and right visual guidance devices 200, 201 may comprise lighting or illumination devices, such as but not limited to rope lights (or other lighting/illumination devices) which are positioned so as to extend along all or a portion of the right and left sides of the exercise machine. In the exemplary embodiment shown in the figures, the exercise machine comprises a left guide rail 101 to which is affixed the left visual guidance device 200 and a right guide rail 102 to which is affixed the right visual guidance device 201.

Figure 16:
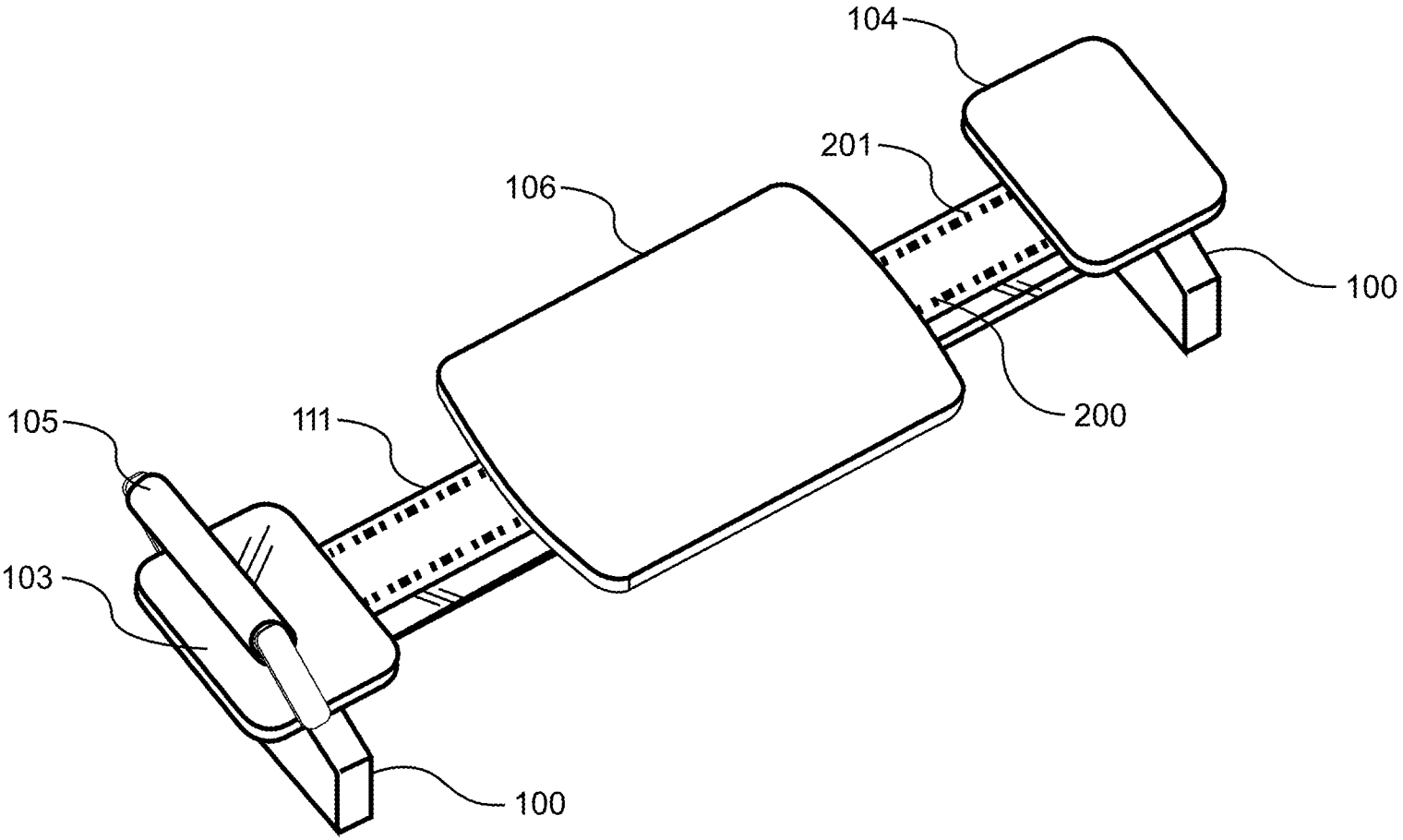
FIG. 16 is an exemplary diagram showing an isometric view of a variation of an improved exercise machine.

It should be appreciated that a single visual guidance device 200, 201 may be looped so as to cover both guide rails 101, 102 in some exemplary embodiments. In other embodiments where the exercise machine comprises a single monorail structure 111 rather than guide rails 101, 102, the visual guidance devices 200, 201 may be instead affixed to the respective sides of the monorail structure 111 such as shown in FIG. 16.

The manner in which the visual guidance devices 200, 201 are affixed to the exercise machine may vary in different embodiments. In some embodiments, the visual guidance devices 200, 201 may simply be looped to surround various structures on the exercise machine. In other embodiments, the visual guidance devices 200, 201 may be affixed by use of clamps, staples, adhesives, brackets, cables such as ties, or other methods.

In some embodiments, the visual guidance devices 200, 201 may be positioned within the rails 101, 102 or monorail structure 111, with the light or display emanating from within. In such embodiments, the rails 101, 102 or monorail structure 111 may comprise openings through which the light may emanate or the display may be seen, or may comprise a transparent or semi-transparent material through which the light or display may be seen.

Figure 10A:
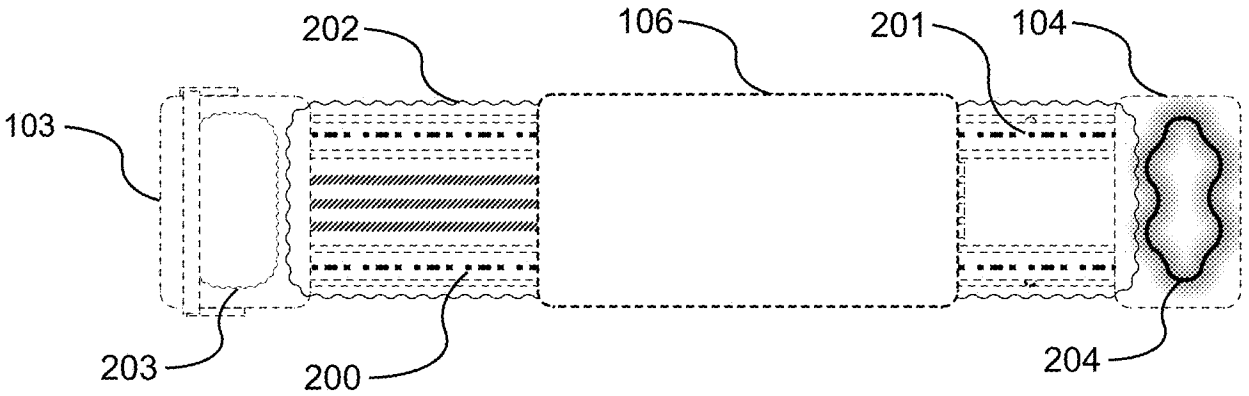
FIG. 10A is an exemplary diagram showing a top view of an improved exercise machine with a lighting arrangement.
Figure 10B:
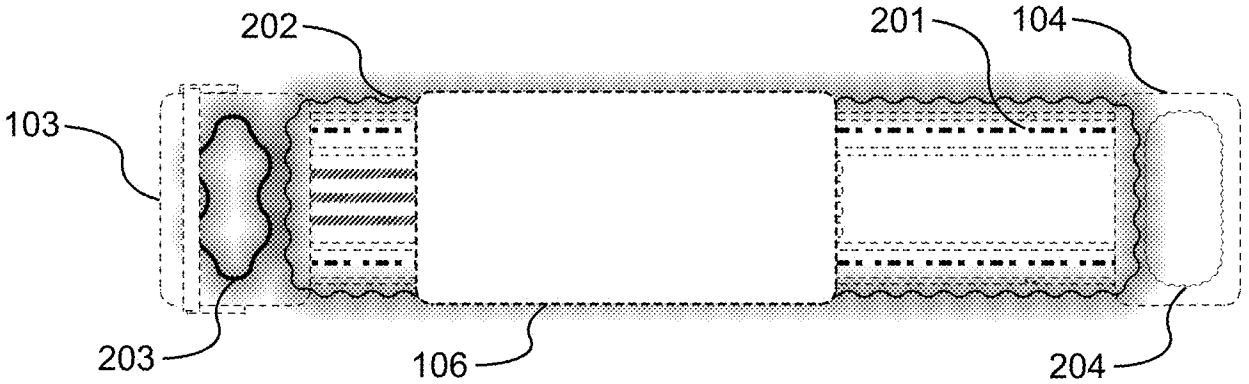
FIG. 10B is an exemplary diagram showing a top view of an improved exercise machine with a variation of a lighting arrangement.

As shown in FIGS. 10A and 10B, the under structure visual guidance device 202 may be positioned underneath the exercise machine. The under structure visual guidance device 202 may be configured to illuminate the ground surface or floor underneath the exercise machine. In some embodiments, the under structure visual guidance device 202 may comprise a projection device so as to project a visual display underneath or around the exercise machine. The under structure visual guidance device 202 may cover the entire length and width of the underside of the exercise machine, or only parts of the underside of the exercise machine.

FIGS. 10A and 10B also illustrate an exemplary front visual guidance device 203 and back visual guidance device 204. The front visual guidance device 203 may be connected to the underside of the front stationary platform 103 so as to illuminate the ground surface or floor below the front stationary platform 103. The back visual guidance device 204 may be connected to the underside of the back stationary platform 104 so as to illuminate the ground surface or floor below the back stationary platform 104.

While the exemplary figures illustrate an embodiment in which the front and back visual guidance devices 203, 204 are connected to the underside of respective front and back stationary platforms 103, 104, it should be appreciated that the front and back visual guidance devices 203, 204 may alternatively be positioned at various other locations. For example, in embodiments in which the exercise machine does not include a front and/or back stationary platform 103, 104, the front and back visual guidance devices 203, 204 may be connected to various other structures at or near the front or back ends of the exercise machine, such as the guide rails 101, 102, single monorail structure 111, or frame elements of the exercise machine. It should also be appreciated that the front and back visual guidance devices 203, 204 may be connected to the sides or top of the exercise machine. In some embodiments, the front and back visual guidance devices 203, 204 may comprise projection devices so as to project a visual display beneath or around the front and/or back ends of the exercise machine.

Various controlling mechanisms may be utilized for controlling the visual guidance devices 200, 201, 202, 203, 204, 206. In an exemplary embodiment, a controller 210 may be utilized to control various parameters of the visual guidance devices 200, 201, 202, 203, 204, 206, such as but not limited to brightness, color, duration, chasing options, speed, and the like. A wireless controller 212 may be provided so that an exercise instructor may control the visual guidance devices 200, 201, 202, 203, 204, 206 during the course of exercise instruction. In other embodiments, the controller 210 may be accessible by the exerciser if exercising without instruction. The wireless controller 210 may comprise a handheld computing device such as a smart phone, tablet, or laptop.

The visual guidance devices 200, 201, 202, 203, 204, 206 may be utilized to convey a wide range of information to the exerciser using the exercise machine. For example, the visual guidance devices 200, 201, 202, 203, 204, 206 may provide carriage velocity instructions to the exerciser so as to instruct the exerciser to move the slidable carriage 106 at a designated speed. In some embodiments, the carriage velocity instructions conveyed by the visual guidance devices 200, 201, 202, 203, 204, 206 may be set by the exerciser or instructor, such as by using a wireless controller 212. By way of example, the right and left visual guidance device 200, 201 may each project or display sequential lighting at a certain speed to direct both direction of movement and rate (velocity) of movement of the slidable carriage 106.

FIG. 1 is an exemplary diagram showing an isometric view of an improved exercise machine. In the drawing, a substantially longitudinal exercise machine comprises a frame such as a plurality of base support members 100 supporting a track, such as left and right parallel guide rail 101, 102, a front stationary exercise platform 103, and an opposed back stationary exercise platform 104. A front end handle assembly 105 provides a gripping support structure for an exerciser 300 to grasp for stability during exercise. A slidable carriage 106 is slidable along substantially the length of the parallel guide rails 101, 102 just described by a plurality of wheels which may be rotatably affixed to the underside of the carriage 106 and roll upon the parallel guide rails 101, 102.

To provide for an exercise resistance against which an exerciser 300 is intended to work, one or more biasing members 107 are shown removably affixed between the machine structure proximate to the front stationary platform 103 and the slidable carriage 106. As the slidable carriage 106 is therefore slid upon the parallel guide rails 101, 102 toward the distal back stationary platform 104, the biasing members 107 induce a resistance force in a direction back toward the proximate front platform 103.

As can be readily seen, a substantially continuous string of visual guidance devices 200, 201 is shown in the form of a left visual guidance device 200 and a right visual guidance device 201, each visual guidance device 200, 201 affixed to substantially the upper surface and extending substantially the length of the respective left and right parallel guide rails 101, 102 of the exercise machine.

Those skilled in the art will appreciate that a visual guidance device 200, 201, 202, 203, 204, 206 comprising a rope light, also referred to as a string light or string of lights, may comprise a plurality of individual lights that may be separately switched on or off at various sequences and time intervals, one such interval producing the illusion that the lights are moving along the length of the rope light. This illusion is commonly referred to as chasing lights.

Figure 2:
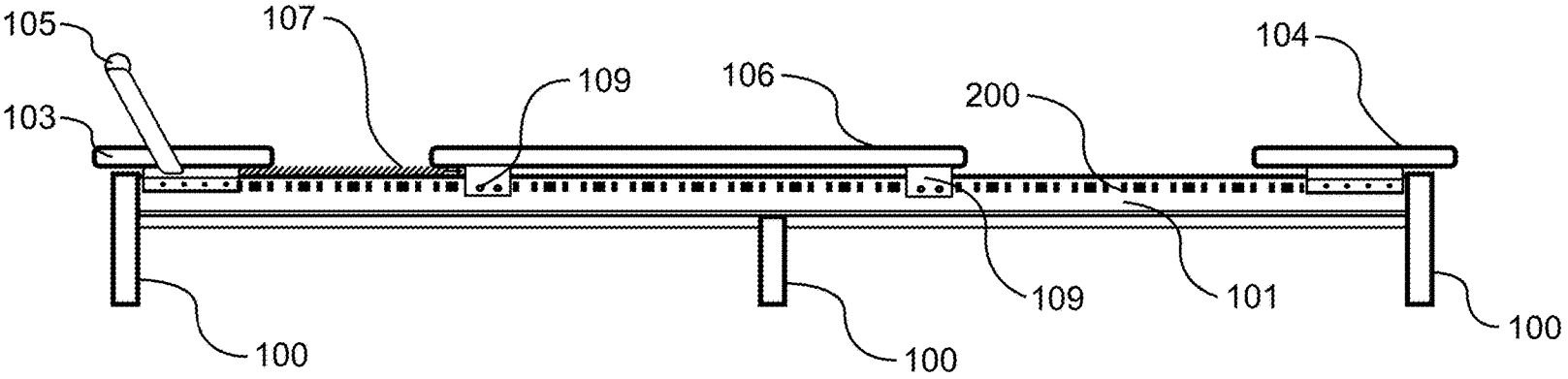
FIG. 2 is an exemplary diagram showing a side view of an improved exercise machine.

FIG. 2 is an exemplary diagram showing a side view of an improved exercise machine. In the drawing, a substantially longitudinal exercise machine comprises a plurality of base support members 100 supporting a left parallel guide rail 101, a front stationary exercise platform 103 and front handle assembly 105, a back stationary exercise platform 104, and a slidable carriage 106 slidable along substantially the length of the parallel guide rails 101, 102 just described. A plurality of carriage wheel assemblies 109 are shown affixed to the right and left sides of the slidable carriage 106, the wheels providing for low friction contact between the slidable carriage 106 and the parallel guide rails 101, 102, and further serving to prevent the slidable carriage 106 from derailing from the parallel guide rails 101, 102.

One or more biasing members 107 are shown affixed at one end of the machine structure proximate to the front stationary platform 103, with the opposed end removably attached to the slidable carriage 106. A plurality of biasing members 107 may be removably attached to the carriage 106 so as to induce different resistance forces against the carriage 106 as may be desired by the exerciser 300.

A left visual guidance device 200 can be seen affixed to substantially the upper surface of the left parallel guide rail 101 and extending substantially the length thereof.

Figure 3:
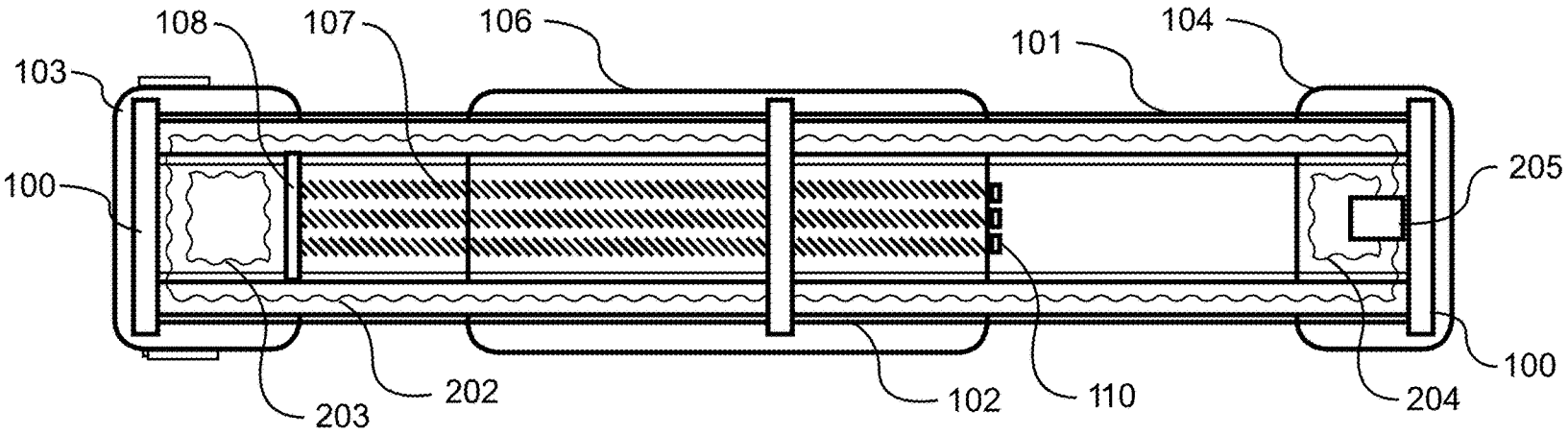
FIG. 3 is an exemplary diagram showing a bottom view of an improved exercise machine.

FIG. 3 is an exemplary diagram showing a bottom view of an improved exercise machine. In the drawing, the underside of the base support members 100 can be readily seen, as well as the underside of the front stationary platform 103, the back stationary platform 104, the left parallel guide rail 101, the right parallel guide rail 102, and the slidable carriage 106. A plurality of biasing members 107 are shown with a first end affixed to a stationary structural member referred to herein as a biasing member anchor 108, and the opposed ends of the biasing members 107 removably attached to the distal end of the slidable carriage 106 by engaging the biasing member selector knobs 110 with a mating structure which is affixed to substantially the distal end of the slidable carriage 106.

A controller module 205 is shown affixed to the machine structure proximate to the underside of the back stationary platform 104, however, the attaching location of the controller is not meant to be limiting, and the controller may be affixed to the exercise machine at any preferred location. The control module 205 may be adapted to change an on/off state of one or more visual guidance circuits, as well as changing any of the available visual guidance parameters associated with each circuit, the parameters including but not limited to light color, light intensity, chasing light mode, the chasing speed, the chasing direction, pulsating frequency and/or intensity, and the sequential or simultaneous switching of one or more circuits, substantially all of the visual guidance parameters provided so as to instruct an exerciser 300 during the course of exercising on the machine.

Although not shown, those skilled in the art will appreciate that the controller comprises at least a microprocessor, local memory, and an electrical power source.

In the drawing, the controller module 205 controls a plurality of circuits shown as wavy lines, with a first circuit being a front visual guidance device 203, an under structure visual guidance device 202, and a back visual guidance device 204. The control module 205 further controls the one or more circuits of the left visual guidance device 200 and right visual guidance device 201, but which are affixed to the substantially upper surface of the parallel guide rails 101, 102 as previously described.

The visual guidance devices 200, 201, 202, 203, 204, 206 just described are not meant to be limiting, and although shown as comprising individual rope lights, each providing a plurality of individually illuminable lamps, the visual guidance devices 203, 204 may comprise a single lamp, or a plurality of lamps that illuminate substantially downward towards the floor, and illuminate laterally and medially in relation to the horizontal plane of the underside of the end platforms of the machine. Further, the sizes and locations of the visual guidance devices 200, 201, 202, 203, 204, 206 are intended to serve merely as possible topographical reference locations, and are not intended to limit the lengths, sizes or locations to those shown in the drawing.

Figure 4A:
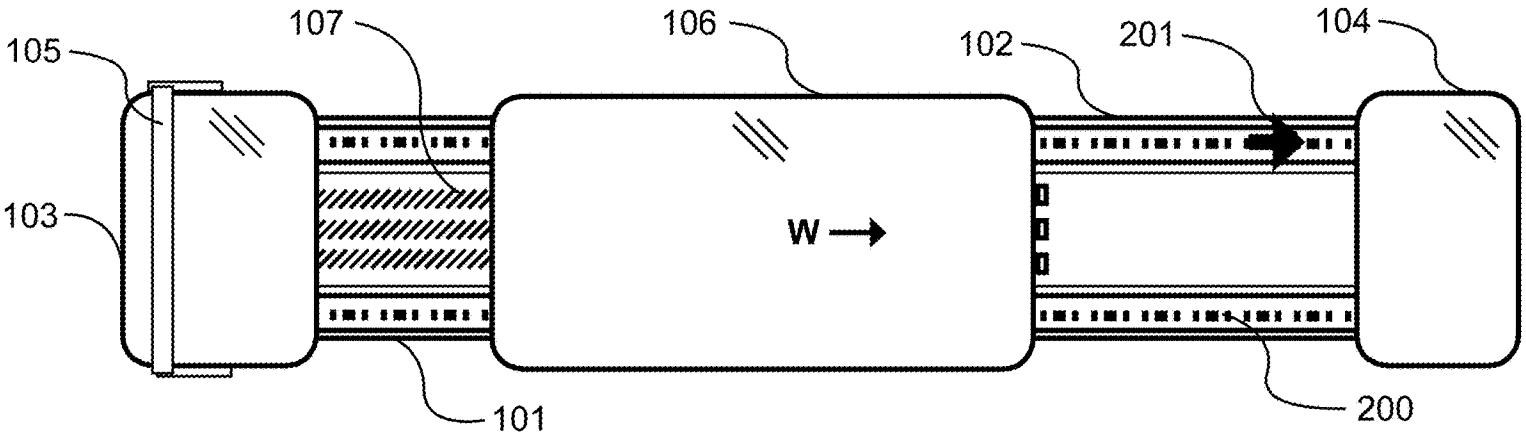
FIG. 4A is an exemplary diagram showing a top view of a variation of an improved exercise machine.

FIG. 4A is an exemplary diagram showing a top view of a variation of an improved exercise machine comprising a left and right parallel guide rail 101, 102, a front stationary exercise platform 103, a front end handle assembly 105, a back stationary exercise platform 104, and a slidable carriage 106 slidable along substantially the length of the parallel guide rails 101, 102 between the front and back stationary platforms 103, 104, a plurality of biasing members 107 removably affixed between the machine structure proximate to the front stationary platform 103 and the slidable carriage 106 as previously described. A right visual guidance device 201 and a left visual guidance device 200 are shown affixed to substantially the upper surface of their respective parallel guide rails 102, 101.

In the drawing, the slidable carriage 106 is shown with an arrow and W indicating the direction in which the carriage will move under an exerciser's 300 work load opposed to the exercise resistance provided by the biasing members 107.

In practice, an exerciser 300 would move the slidable carriage 106 in the direction of the arrow shown in the drawing, and at the same time, the right visual guidance device 201 would be actuated in a chasing mode with the lights appearing to chase one another in the direction of the large arrow shown on the visual guidance device 201. The speed of the chasing lights would be actuated at the preferred speed that the exerciser 300 should be moving the carriage 106, thereby providing guidance to the exerciser 300 regarding the preferred speed of the exercise.

It should be noted that the left visual guidance device 200 may be a continuation of the right visual guidance device 201, or may be a distinctly separate device controlled by the controller module 205 independent of the right visual guidance device 201.

Figure 4B:
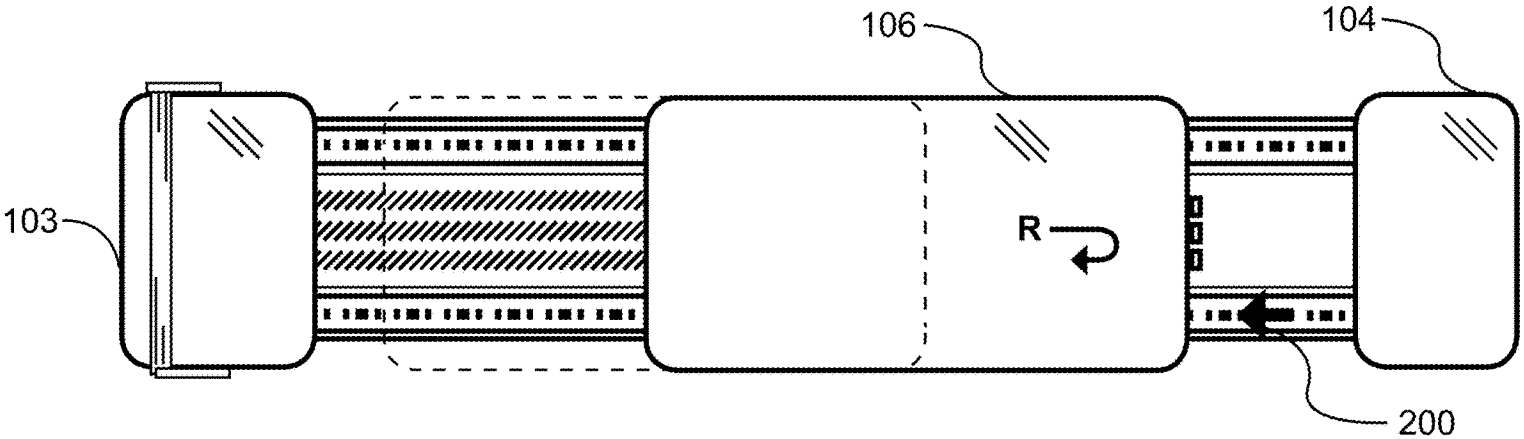
FIG. 4B is an exemplary diagram showing a top view of a variation of an improved exercise machine.

FIG. 4B is an exemplary diagram showing a top view of a variation of an improved exercise machine wherein the slidable carriage 106, having been moved by an exerciser 300 from a starting position proximate to the front stationary platform 103 as indicated by the dashed line, in a direction toward the distal back stationary platform 104, the position of the carriage 106 representing the maximum range of movement, and correspondingly the maximum range of motion by the exerciser 300 for a particular exercise.

When an exerciser 300 reaches the maximum range of motion, the motion would need to be reversed as indicated by the U-turn arrow and R on the carriage 106. When the carriage 106 direction is reversed and re-directed toward the front stationary platform 103, the left visual guidance device 200 will be actuated in a chasing mode with the lights appearing to chase one another in the direction of the large arrow shown on the visual guidance device 200. The speed of the chasing lights would be actuated at the preferred speed that the exerciser should move the carriage 106 in a reverse direction back towards the front stationary platform 103, thereby providing guidance to the exerciser 300 regarding the preferred speed of the exercise during the return cycle of the exercise.

As just described (FIG. 4A, FIG. 4B) the right visual guidance device 201 and left visual guidance device 200 may be controlled by the controller module 205 as separate circuits. In such a configuration, the left and right visual guidance devices 200, 201 may be actuated continuously, with opposed light chasing directions that would provide for exercise speed instruction to the exerciser 300 during both the work direction and the return cycle direction, with different chasing speeds established separately for the left and right visual guidance devices 200, 201. Alternatively, the left and right visual guidance devices 200, 201 may comprise a single rope light that is looped at substantially one distal end of the machine, the loop bridging from one parallel guide rail 101, 102 to the opposed parallel guide rail 101, 102. In such a configuration, the single looped visual guidance device 200 would be controlled as a single circuit that would establish the light chase speed on one parallel guide rail 101, 102 as being substantially the same as the light chase speed on the opposed parallel guide rail 101, 102.

Figure 5:
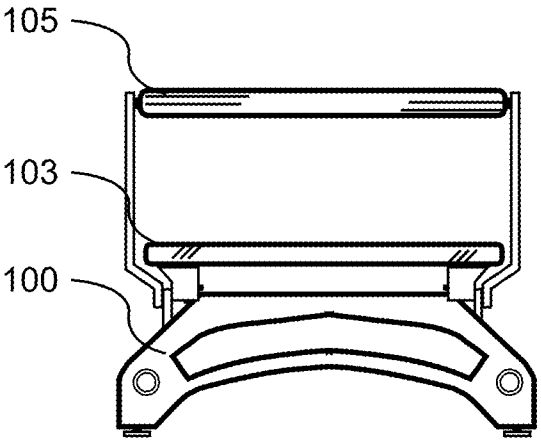
FIG. 5 is an exemplary diagram showing a front view of an improved exercise machine.

FIG. 5 is an exemplary diagram showing a front view of an improved exercise machine. A base support member 100 supports the proximate ends of a pair of parallel guide rails 101, 102, a front stationary platform 103, and a front end handle assembly 105.

Figure 6:
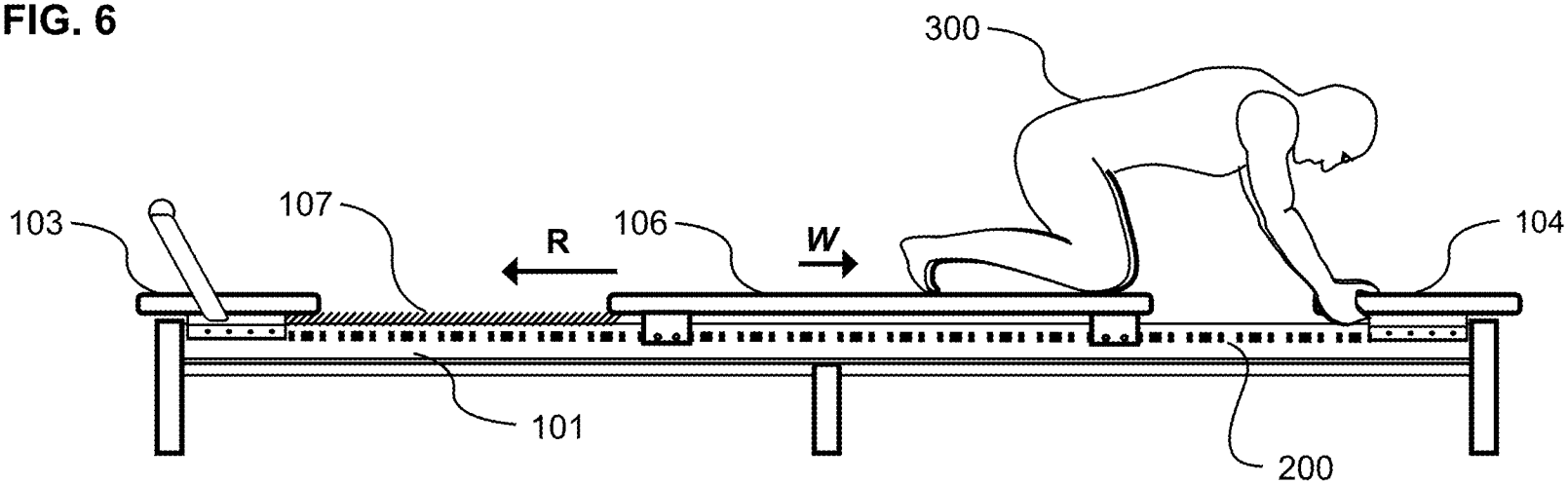
FIG. 6 is an exemplary diagram showing a side view of an improved exercise machine with an exerciser.

FIG. 6 is an exemplary diagram showing a side view of an improved exercise machine with an exerciser 300 positioned upon a slidable carriage 106 with the exerciser's hands gripping the proximate edge of the back stationary platform 104 while performing an exercise. As can be seen, at least one biasing member 107 is affixed between substantially the front stationary platform 103 and the slidable carriage 106 as previously described. The biasing member 107 produces an exercise resistance force in the direction of the arrow and R. In order to overcome the biasing member force, the exerciser must pull the carriage in a work direction indicated by the arrow and W with sufficient effort to overcome the force induced by the one or more biasing members.

It is well known in the field of athletics that efficient exercising requires that an exerciser control the speed at which they perform an exercise. In the drawing, a left visual guidance device 200 is shown affixed to the upper surface of a left parallel guide rail 101. In practice, the control module will have opened the channel that controls the left visual guidance device 200, and causes the lights to illuminate in a chasing configuration whereby the speed at which the lights appear to be chasing each other is indicative of the speed at which the exerciser is instructed to move the slidable carriage 106. As previously described, the chasing direction of the left visual guidance device 200 may guide the exerciser when moving the slidable carriage in a direction towards the front stationary platform 103, while the chasing direction of the right visual guidance device 201 may guide the exerciser when moving the slidable carriage 106 in a direction towards the back stationary platform 104, or vice versa.

In other embodiments described below, the chasing light directions just described may be reversed, or may chase in the same direction simultaneously.

In the following drawings FIG. 7A through 10B, a top view of the exercise machine is shown with the front stationary platform 103, back stationary platform 104 and parallel guide rails 101, 102 shown as a dotted lines in order to facilitate describing the visual guidance devices 200, 201, 202, 203, 204, 206 affixed to the platforms 103, 104 and guide rails 101, 102. Further, a portion of the front and back stationary platforms 103, 104 have been cut away to better expose elements of the lighting system that would otherwise be obscured by the platforms.

Figure 7A:
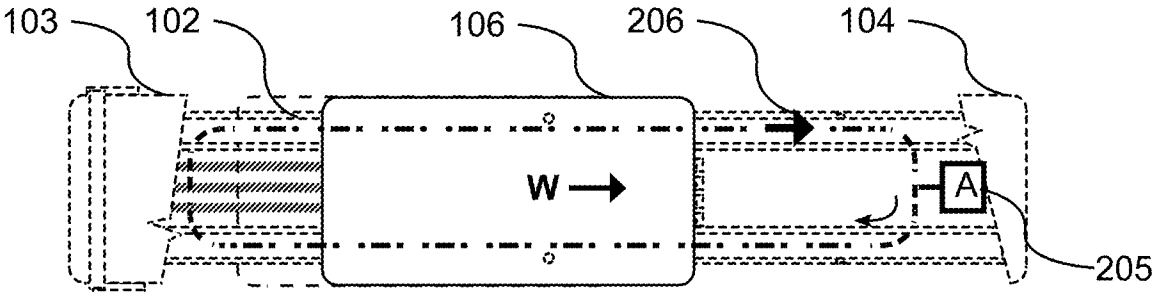
FIG. 7A is an exemplary diagram showing a top view of an improved exercise machine with a lighting arrangement.

FIG. 7A is an exemplary diagram showing a top view of an improved exercise machine with a lighting arrangement. More specifically, a single channel looped visual guidance device 206 is described more fully. A controller module 205 is affixed to the structure of an exercise machine, the controller 205 providing for a single channel A. In the illustration, the perceived direction of the chasing lights is in a clockwise direction around the loop as indicated by the heavy arrow and reversing arrow proximate to the controller module 205.

In practice, as an exerciser first moves the slidable carriage 106 in a direction away from the front stationary platform 103 and towards the back stationary platform 104 as indicated by the arrow and W, the exerciser being instructed to move the slidable carriage 106 at a speed that matches the speed of the chasing lights that are affixed to the upper surface of the right parallel guide rail 102.

Figure 7B:
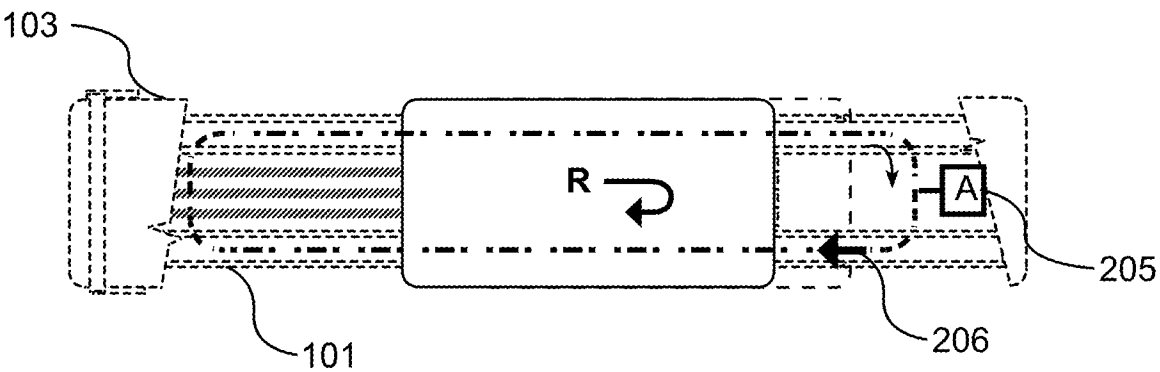
FIG. 7B is an exemplary diagram showing a top view of an improved exercise machine with a variation of a lighting arrangement.

FIG. 7B is an exemplary diagram showing a top view of an improved exercise machine with a variation of a visual guidance arrangement. As the exerciser 300 completes the work portion of the exercise cycle as just described FIG. 7A, the exerciser 300 must momentarily stop the movement of the slidable carriage 106 prior to reversing the direction of the carriage 106 as indicated by the U-turn arrow and R. During the return movement of the slidable carriage 106 in a direction back towards the front stationary platform 103, the exerciser 300 is instructed to move the slidable carriage 106 at a speed that matches the speed of the chasing visual guidance lights that are affixed to the upper surface of the left parallel guide rail 101.

The chasing lights on the right parallel guide rail 102 and left parallel guide rail 101 comprise a single visual guidance device 206, therefore, the apparent chasing speed of the lights on the right parallel guide rail 101 may be the same speed as the chasing lights on the left parallel guide rail 102.

Figure 8A:
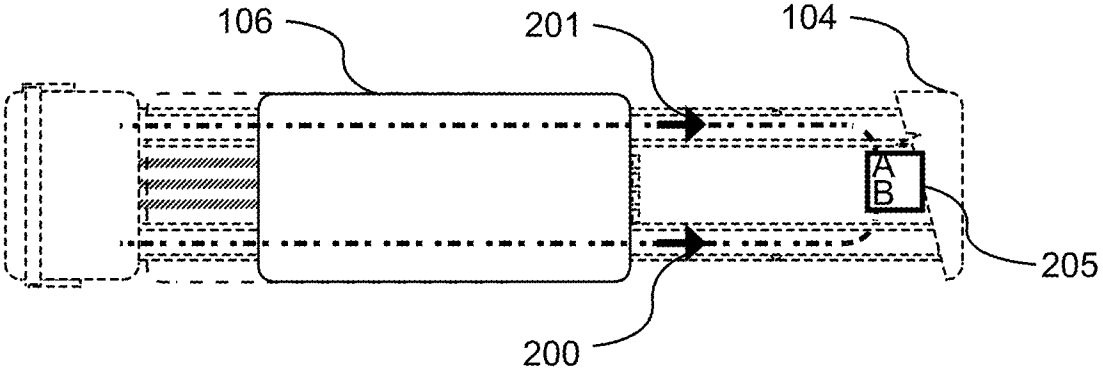
FIG. 8A is an exemplary diagram showing a top view of an improved exercise machine with a lighting arrangement.

FIG. 8A is an exemplary diagram showing a top view of an improved exercise machine with a visual guidance arrangement. A 2-channel controller module 205 is shown with a channel A controlling the right visual guidance device 201, and a channel B controlling the left visual guidance device 200. Both channel A and channel B are configured such that the chasing direction of the lights on the opposed visual guidance devices 200, 201 are substantially the same, the chasing lights on the opposed visual guidance devices 200, 201 providing instruction for an exerciser to move the slidable carriage 106 in a direction towards the back stationary platform 104 with a speed that substantially equals the speed of the chasing lights.

Figure 8B:
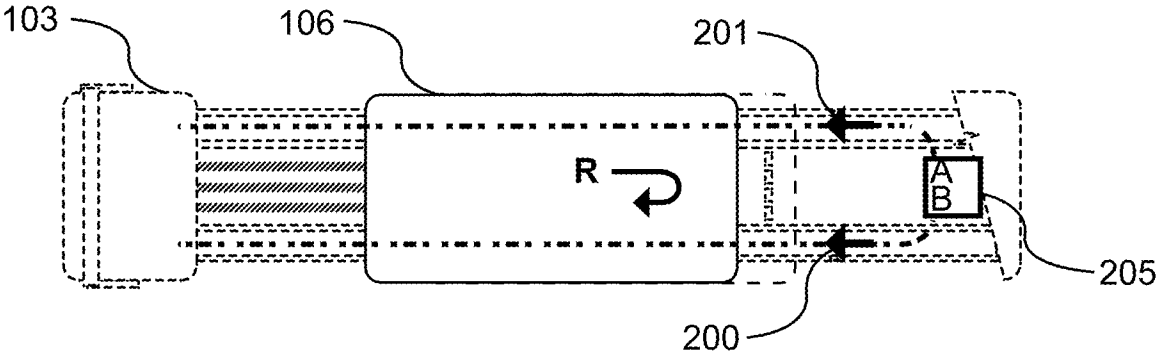
FIG. 8B is an exemplary diagram showing a top view of an improved exercise machine with a variation of a lighting arrangement.

FIG. 8B is an exemplary diagram showing a top view of an improved exercise machine with a variation of a visual guidance arrangement. Upon completing the work cycle of the exercise, the exerciser 300 must reverse the direction of the slidable carriage 106 back toward the front stationary platform 103 as indicated by the U-turn arrow and R on the carriage 106. As can be readily seen by the arrows on the right visual guidance device 201 and left visual guidance device 200, signals from the controller module 205 have caused the chasing direction of the lights to reverse from the direction just described, the reversed direction of the chasing lights providing instruction for an exerciser 300 to move the slidable carriage 106 in a direction towards the front stationary platform 103 with a speed that substantially equals the speed of the chasing lights.

It should be noted that the controller module 205 causes the chasing lights on both channel A and channel B to concurrently reverse the chasing direction in response to pre-programmed instructions, and/or in response to receiving data from one or more carriage sensors not shown but which provide carriage location and/or carriage movement data. Because channel A and channel B are independently controlled, any visual guidance attribute or parameter instructed by channel A is independent of any lighting attribute instructed by channel B.

Figure 9A:
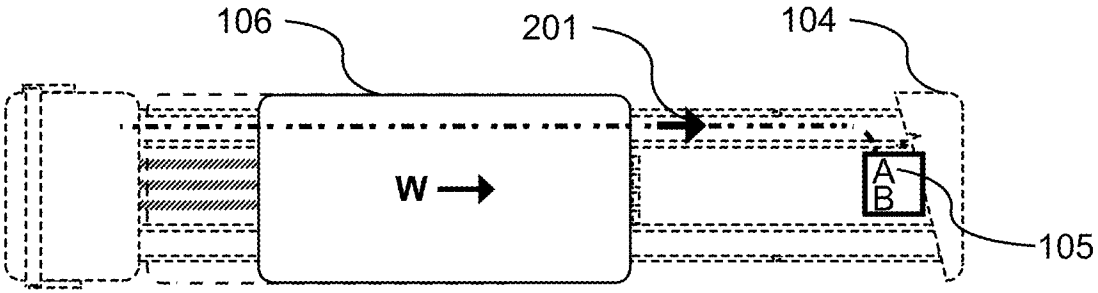
FIG. 9A is an exemplary diagram showing a top view of an improved exercise machine with a lighting arrangement.

FIG. 9A is an exemplary diagram showing a top view of an improved exercise machine with a visual guidance arrangement. A 2-channel controller module 205 is shown with a channel A controlling the right visual guidance device 201, configured to illuminate the lights to chase in a direction shown by the heavy arrow, the direction and speed of the chasing lights providing instruction to an exerciser to move the slidable carriage 106 in a direction towards the back stationary platform 104 at a speed that substantially matches the speed of the chasing lights.

The drawing further shows that the channel B circuit is inactive as may have been programmatically instructed, or as may have been manually deactivated by an exercise instructor.

Figure 9B:
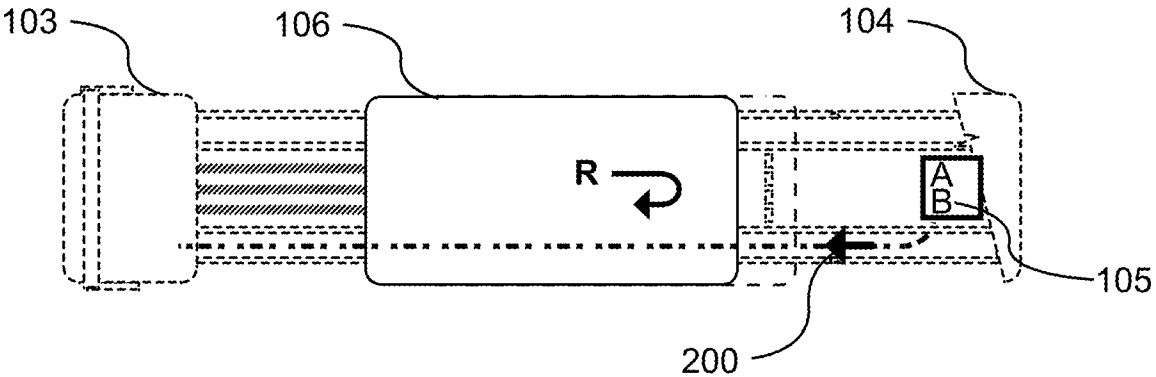
FIG. 9B is an exemplary diagram showing a top view of an improved exercise machine with a variation of a lighting arrangement.

FIG. 9B is an exemplary diagram showing a top view of an improved exercise machine with a variation of a visual guidance arrangement. A 2-channel controller module 205 is shown with a channel B controlling the left visual guidance device 200, configured to illuminate the lights to chase in a direction shown by the heavy arrow, the direction and speed of the chasing lights providing instruction to an exerciser to move the slidable carriage 106 in a direction towards the front stationary platform 103 at a speed that substantially matches the speed of the chasing lights.

It is sometimes preferred to perform eccentric exercises in which the return portion of an exercise cycle is longer than the work portion of the cycle. Therefore, one embodiment of the lighting system just described in FIG. 9A, FIG. 9B provides for the chasing speed of the right visual guidance device 201 which guides the speed of the work phase of the exercise cycle to be faster than the speed of the chasing lights of the left visual guidance device 200, thereby meeting the parameters of an eccentric exercise.

FIG. 10A is an exemplary diagram showing a top view of an improved exercise machine with a visual guidance arrangement. The visual guidance system of the improved exercise machine is not limited to the left and right visual guidance devices 200, 201 affixed to the parallel guide rails 101, 102 as described above in detail. Various visual guidance configurations that illuminate or project under and around the machine below the upper surface of the slidable carriage 106 and stationary end platforms 103, 104 is sometimes desirable for further instructing the exerciser 300.

In the drawing, the front visual guidance device 203 and back visual guidance device 204 are shown in their approximate locations relative to the end platforms 103, 104 and slidable carriage 106. Although they are affixed to the underside of their respective end platforms 103, 104, for illustrative purposes only, they are shown positioned above the platforms 103, 104. Similarly, the under structure visual guidance device 202 may appear to be affixed above certain structural elements of the machine, but in practice they are affixed to the underside of the machine.

The exercise machine comprises a front exercise platform 103, a slidable carriage 106, a back platform 204, and a pair of parallel guide rails 101, 102 extending substantially the length of the machine between the front and back stationary platforms 103, 104. Not shown, but as would be readily understood by those skilled in the art, the under-lights 203, 204, and left and right visual guidance devices 200, 201 described herein would be electrically connected to and thereby controlled by a controller module 205.

In the drawing, a front visual guidance device 203 is shown configured to the off or dimmed position as indicated by the thin wavy line. An under structure visual guidance device 202 is shown in a variable configuration as indicated by the medium weight wavy line, the variable configuration not being limited to one of many lighting parameters including medium intensity on, on and pulsating at a prescribed frequency, and/or illuminating the lamps at preferred color or combination of changing colors.

Further, a back visual guidance device 204 is shown in a switched-on configuration as indicated by the heavy, glowing wavy line. As one example of the use of the back under-light in 204 practice, it may be desirable to instruct the exerciser to increase the speed at which they move the slidable carriage 106 in a direction towards the back stationary platform 104. In such an instance, one method of providing instruction would be to brightly illuminate the back visual guidance device 204 in a green color, pulsating at a high frequency so as to motivate the exerciser 300 to increase their speed toward the back under-light.

FIG. 10B is an exemplary diagram showing a top view of an improved exercise machine with a variation of a lighting arrangement.

In the drawing, a back visual guidance device 204 is now shown configured to the off or dimmed position as indicated by the thin wavy line. An under structure visual guidance device 202 is shown in an on/bright configuration as indicated by the heavy glowing wavy line. The controller module 205 may direct the under structure visual guidance device 202 to exhibit various visual guidance attributes such as a prescribed color and/or changes in color, pulsating on/off or bright/dim, and/or initiating a chasing sequence. The visual guidance parameters just described are not meant to be limiting, and any combination of lighting attributes may be applied to the under structure circuit.

A front visual guidance device 203 is shown in a switched-on configuration as indicated by the heavy, glowing wavy line. As one example of the use of the front visual guidance device 203 in practice, it may be desirable to instruct the exerciser 300 to decrease the speed at which they move the slidable carriage 106 in a direction towards the front stationary platform 103. In such an instance, one method of providing instruction would be to brightly illuminate the front visual guidance device 203 in a red color, pulsating at a slow frequency as a method of directing the exerciser 300 to decrease their speed as the slidable carriage 106 approaches the front visual guidance device 203.

As can be readily understood, there are a nearly unlimited number of combinations of on, off or dimming states of the many individually controlled visual guidance systems, especially given the number of different visual guidance parameters that may be attributed to each lamp. Describing every combination of visual guidance states and parameters would be exhaustive and burdensome, but to do so would reinforce the many instructional attributes of the improved exercise machine lighting systems.

Figure 11:
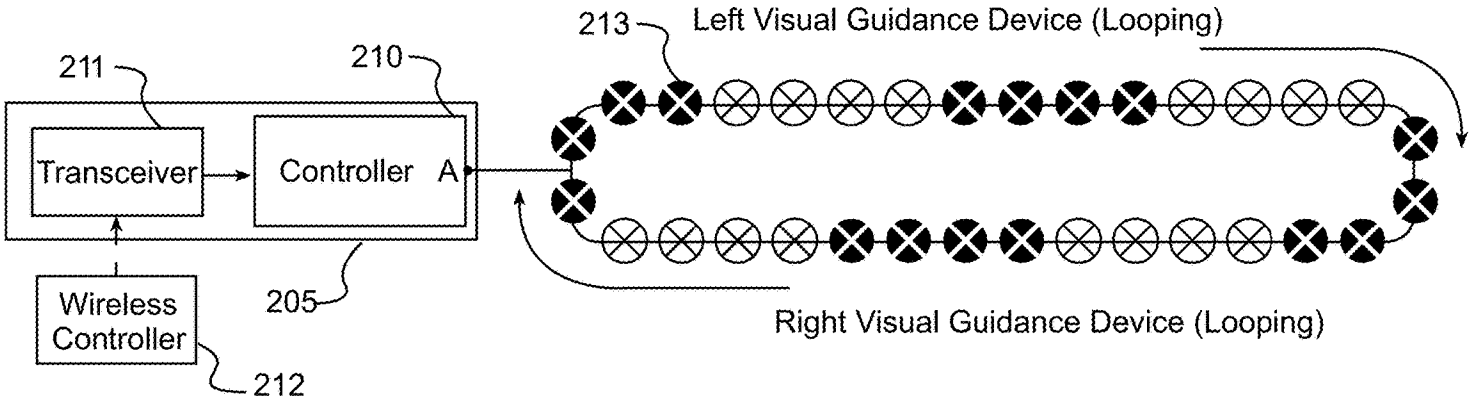
FIG. 11 is an exemplary diagram showing a schematic of a single channel lighting system.

FIG. 11 is an exemplary diagram showing a schematic of a single channel visual guidance system. A controller module 205 comprises a controller 210 with a single channel A output, the controller 210 comprising an electrical switch and a signal processor configured to drive the lighting parameters of lights on a channel A circuit 213. Further, a transceiver 211 is configured to receive a digital signal from a wireless controller 212, and to direct the digital signal to the controller 210. Those skilled in the art will understand that there is a large body of work describing the many circuit designs used to convert a signal received from a wireless controller 212 to instructions that drive the lighting parameters of lights on a circuit. The diagram shown is not meant to be limiting, and any known method of converting the wireless controller 212 signal to a light output condition may be used.

The drawing shows a channel A circuit 213 driving a series of four individual lights or displays illuminated as dark objects with a transparent X followed by a series of four lights or displays not illuminated which are shown as circles with a center X. In practice, a trailing illuminated light or display will be switched off at the same time that the switched off light or display leading the illuminated series is illuminated. This progression provides the illusion that the illuminated lights or displays are chasing each other around the loop of lights or displays. An exemplary configuration for illuminating the left visual guidance device 200 and right visual guidance device 201 controlled by a single circuit was previously shown and described in FIG. 7A, FIG. 7B.

Figure 12:
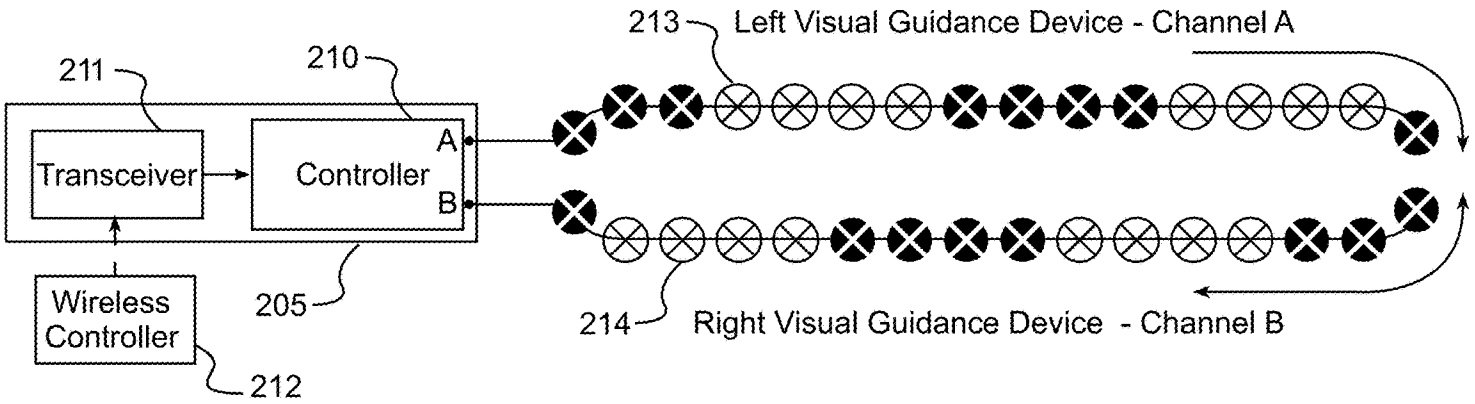
FIG. 12 is an exemplary diagram showing a schematic of a dual channel lighting system.

FIG. 12 is an exemplary diagram showing a schematic of a dual channel visual guidance system as illustrated previously in FIG. 8A, FIG. 8B. More specifically, a controller module 205 comprises a controller 210 with both channel A and channel B outputs, the controller 210 comprising an electrical switch and a signal processor that individually drives the lighting parameters of lights on a channel A circuit 213 and the channel B circuit 214. Further, a transceiver 211 is configured to receive a digital signal from a wireless controller 212, and to direct the digital signal to the controller 210.

In the drawing, one of many possible configurations shows a condition in which the lights on the channel A circuit 213 are illuminated in a sequence whereby the lights appear to be chasing each other in one direction as indicated by the one-headed arrow, wherein the lights on the channel B circuit 214 are sequenced to first chase on one direction, then reverse at a prescribed time to chase in the reverse direction as indicated by the double headed arrow.

Figure 13:
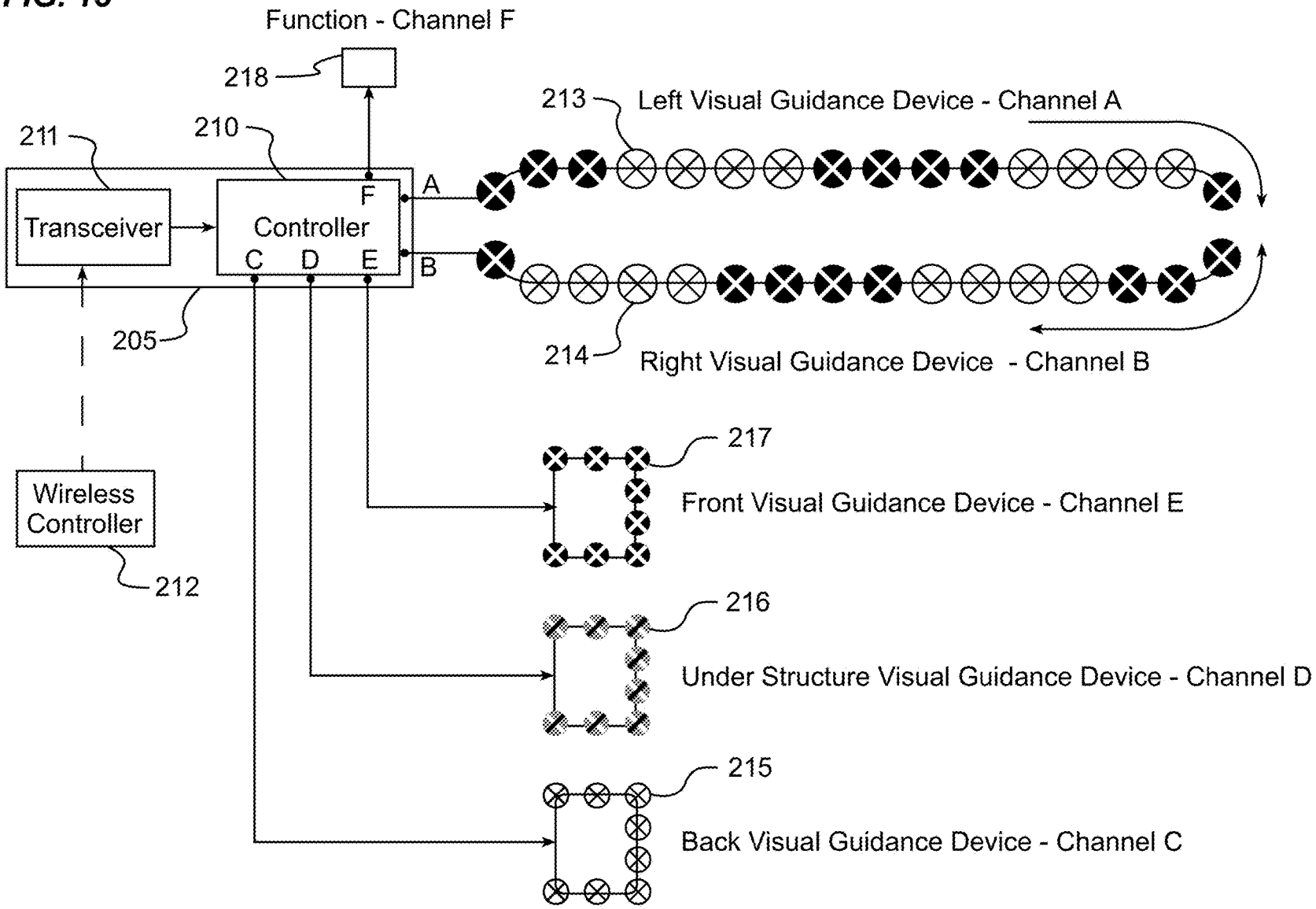
FIG. 13 is an exemplary diagram showing a schematic of a multi-channel lighting system.

FIG. 13 is an exemplary diagram showing a schematic of a multi-channel lighting system. More specifically, a controller module 205 comprises a six channel controller 210 with outputs channel A-F, the controller comprising an electrical switch and a signal processor that individually drives the visual guidance parameters of lights or displays on any one or more circuits 213, 214, 215, 216, 217, 218. A transceiver 211 is configured to receive a digital signal from a wireless controller 212, and to direct the digital signal to the controller 210, thereby instructing the visual guidance parameters for each and all of the circuits 213, 214, 215, 216, 217, 218.

The wireless controller 212 may comprise a Bluetooth-enabled computing device, such as but not limited to a smart phone, tablet, desktop computer, or laptop computer which may be operable by an exercise instructor, the computing device being operable to execute a software application programmed to control an exercise machine lighting system, paired to one or more improved exercise machines so as to operate the lighting system described above. A wireless controller 212 may also comprise a Bluetooth, ultraviolet or infrared controller affixed to the exercise machine operable by the exerciser 300, though the use of a wireless controller 212 is not meant to be limiting. In other embodiments, a hard wired controller operable by the exerciser 300 and/or an exercise instructor may be used in place of a wireless controller 212.

In the drawing, a channel A is shown to control the channel A circuit 213 for a left visual guidance device 200, and a channel B circuit 214 is shown to control a right visual guidance device 201. A channel C circuit 215 controls a back visual guidance device 204, a channel D circuit 216 controls an under-structure visual guidance device 202, and a channel E circuit 217 controls a front visual guidance device 203.

Further, a channel F circuit 218 is shown controlling the function of another electrical device that may produce another visual or audible instruction such as but not limited to another light source such as rope light or strobe light, a tone generator, a projector, or a speaker.

As can be seen, the controller module 205 may be configured to control any reasonable number of circuits 213, 214, 215, 216, 217, 218 independently, and may actuate any one, any combination of, or all of the circuits 213, 214, 215, 216, 217, 218 in any sequence, or simultaneously, each with separate parameters as may be preferred for use as in exercise instruction.

Continuing to reference FIGS. 10-13, it can be seen that the left and right visual guidance devices 200, 201 have been configured so as to loop around the outer body of the exercise machine. The left visual guidance device 200 is illustrated as comprising sixteen individually-controllable lights or displays that may be individually illuminated or turned off. Similarly, the right visual guidance device 201 is illustrated as comprising sixteen individually-controllable lights or displays that may be individually illuminated or turned off. Each of the lights or displays of the right and left visual guidance devices 200, 201 is shown at equidistance-spacing with respect to the remaining lights or displays of the right and left visual guidance devices 200, 201.

It should be appreciated that alternate spacing, orientation, and positioning may be utilized, and FIGS. 10-13 should thus not be construed as limiting. Further, the number of lights or displays making up the right or left visual guidance devices 200, 201 may vary and should not be construed as limited to the embodiment showing sixteen lights or displays, as more or less lights or displays may be utilized in different embodiments.

Figure 14:
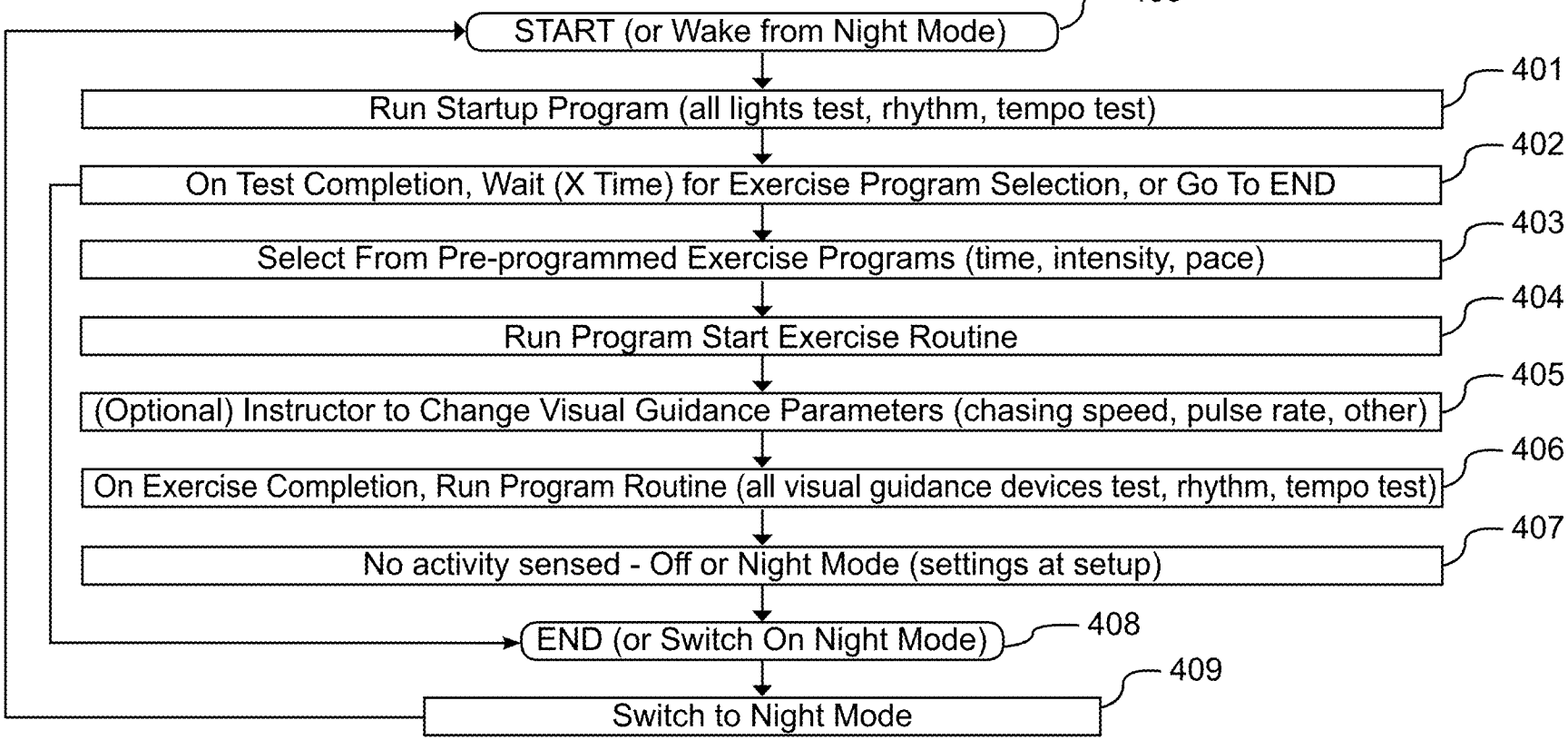
FIG. 14 is an exemplary diagram showing a flow chart for operating an exercise machine lighting system.

FIG. 14 is an exemplary diagram showing a flow chart for operating an exercise machine visual guidance system. An exerciser 300 or an exercise instructor, either one being considered a user for purposes of this illustration, may begin a light or display driven instruction session by selecting on a software application a start button 400. This action runs a pre-programmed startup sequence 401 that may turn on or off any or all visual guidance devices 200, 201, 202, 203, 204, 206 under any of the visual guidance parameters 207, 208, 209 and for any preferred duration. Upon completion of the startup sequence, the software program provides a pre-programmed delay period for the user to select a prerecorded exercise program. If the user fails to select a program within the allotted time period, the program will determine that the session has ended, and will end the session 408.

The user desiring to exercise will select a pre-programmed exercise name or exercise routine 403 within the allocated time, the exercise name correlating to a specific lighting program that has previously been recorded. The recorded program may be stored on the memory of the controller module, or on the memory of a wireless controller, for instance, a smartphone, or may be accessed remotely by a communications network such as the Internet.

Upon selecting the exercise name, the user starts the routine 404. During the exercise routine run time, an instructor may use the wireless controller to modify the program 405 by changing one or more of the many program parameters.

At the completion of the exercise routine, an end routine program 406 is initiated to indicate that the exercise session is finished. Thereafter, if no further machine or controller 210 activities are sensed by the software, the system will switch to an off mode 407. The instructions for an off mode 407, having been previously programmed and stored in memory as just described, will either turn the machine off 408, or switch to night mode 409, with night mode preferably activating a program that uses a low power, low illumination lighting sequence.

To turn the machine on, if previously turned off, or to wake the machine from night mode, the user would again depress start 400 on the controller application and continue the sequence as just described.

Figure 15:
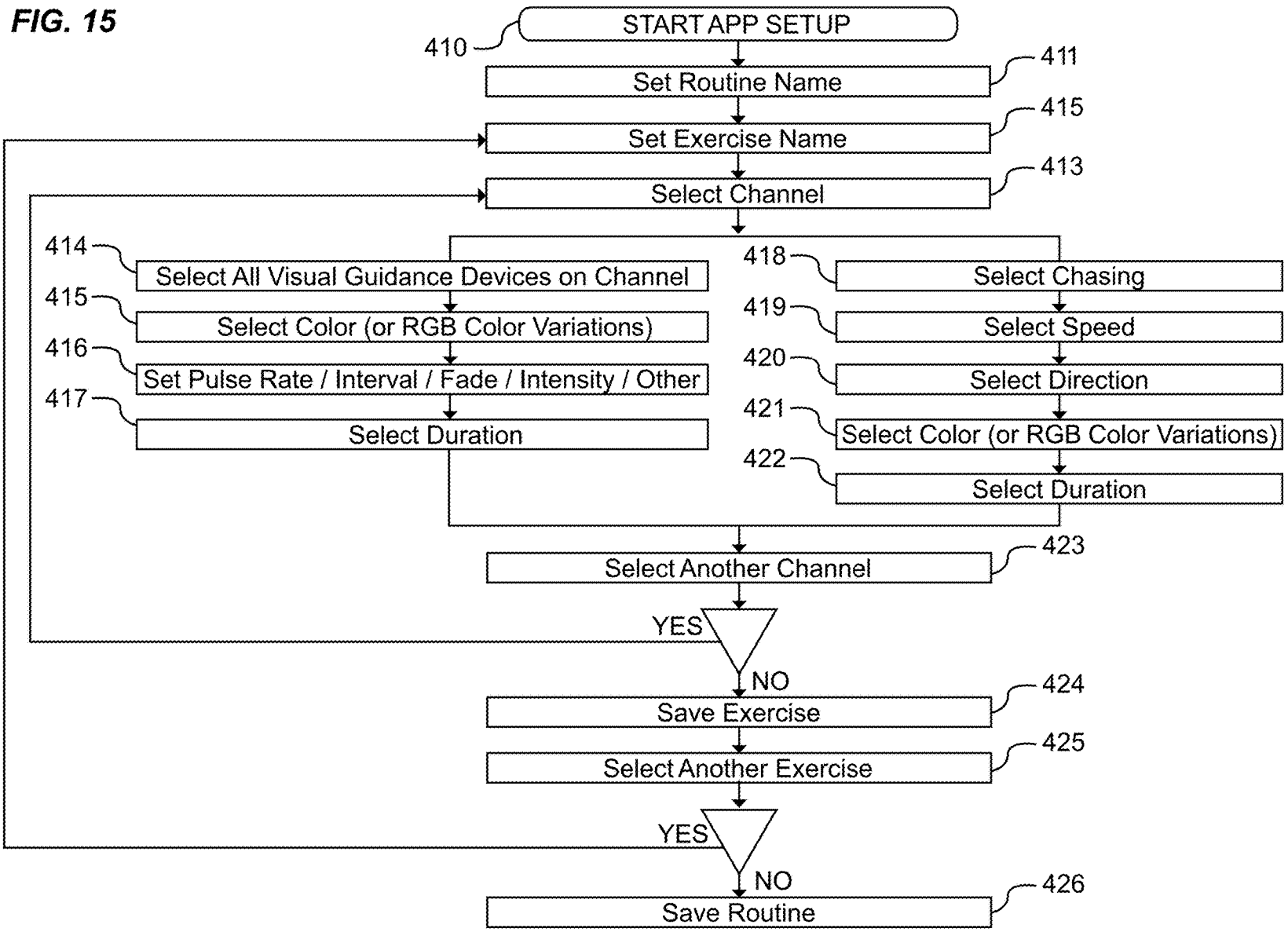
FIG. 15 is an exemplary diagram showing a flow chart for programming an exercise machine lighting system.

FIG. 15 is an exemplary diagram showing a flow chart for one possible process for programming an exercise machine visual guidance system. Upon opening a software application to control the visual guidance instruction system, a user selects the app setup screen 410, enters a routine name 411, the routine comprising least one or more exercises to be performed for specified durations, and subsequently enters the name of an exercise 415 to be performed during the named routine.

The user may select the channel 413 to program. Multi-channel controllers 210 provide for individually programming each channel. In the diagram, a user may select to program visual guidance lights or displays individually, as required for chasing lights 418, or to program all lights or displays on a given channel 414 to behave as one lamp.

If programming a channel for chasing lights or displays, the user may select chasing speed 419, then chase direction 420, then light color 421, and the duration of time 422 that the lights or displays would chase. The sequence just described is not meant to be limiting, and the programming sequence may present any parameter in any order. Further, the visual guidance parameters may include may more selections than are presented in this illustrative example such as, but not limited to color fade from one color to another, intensity, dimming before, during or after the chase, the number of non-illuminated lights that define the gap between groups of illuminated lights, or many other combinations of attributes that may control the activity of individual lights or displays.

Upon completing the program for the channel, the user is presented the option to program another channel 423 for the same exercise name, the subsequent channel being actuated concurrently with the first channel. This process would return the user to the select channel screen 413, and would similarly continue for each channel in a multi-channel light instruction system. If programming all lights or displays to illuminate or display as if they comprised a single light or display 414, the user would select the light or display color 415, any visual guidance attributes 416 such as pulsing, pulse rate, interval between pulses, hard on/off or fade on/off, intensity, or any other number of available parameters. Though not shown, separate screens on the programming application may be required to sequence through, and program each of the many possible lighting parameters.

The user would then select the duration 417 for which the visual guidance program would run, the length of time generally being the same length of time that the named exercise would be performed.

Upon completing the program for the channel, the user is presented the option to program yet another channel 423 for the same exercise name, the subsequent channel being actuated concurrently with the other channels programmed for a particular exercise name. This process would return the user to the select channel screen 413, and would continue for each channel in a multi-channel visual guidance instruction system until all channels are programmed.

Upon completing the channel programming for a first named exercise, the user would save the lighting parameters for the named exercise 424, then select whether they desire to create an additional named exercise 425. If the user elects to create another exercise within the named routine, the software returns the user to the set exercise screen 415 from which the user will repeat the process substantially as just described.

On the other hand, if the user has completed the programming of all preferred channels for all named exercises within a named routine, they would save the routine 426 for subsequent playback during the exerciser's performance of the named routine on the improved exercise machine.

FIG. 16 is an exemplary diagram showing an isometric view of a variation of an improved exercise machine. It may be preferred that the track of the exercise machine comprises a single central monorail structure upon which the slidable carriage 106 will traverse, rather than separate left and right parallel guide rails 101, 102 as described above.

In the drawing, a plurality of base support members 100 support a central monorail structure 111 that extends substantially the longitudinal length of the exercise machine. A front stationary platform 103 and a front end handle assembly 105, and a back stationary platform 104 are affixed to the machine structure substantially as previously described. A slidable carriage 106 is movable along substantially the length of the monorail structure 111 by of a plurality of wheels affixed to the underside of the carriage 106 which rotatably engage with channels positioned on the opposed sides of the monorail structure 111. Biasing members are not shown because they are contained within the hollow interior structure of the monorail, but the biasing members are nevertheless removably attachable between the front end of the machine and the slidable carriage 106, thereby inducing an exercise resistance against the slidable carriage 106.

A left visual guidance device 200 and a right visual guidance device 201 are shown on the upper surface of the opposed sides of the monorail structure 111, and function substantially as described in detail in the preceding description of the left visual guidance device 200 and right visual guidance device 201 that are individually affixed to the upper surface of the left and right parallel guide rails 101, 102.

Figure 17:
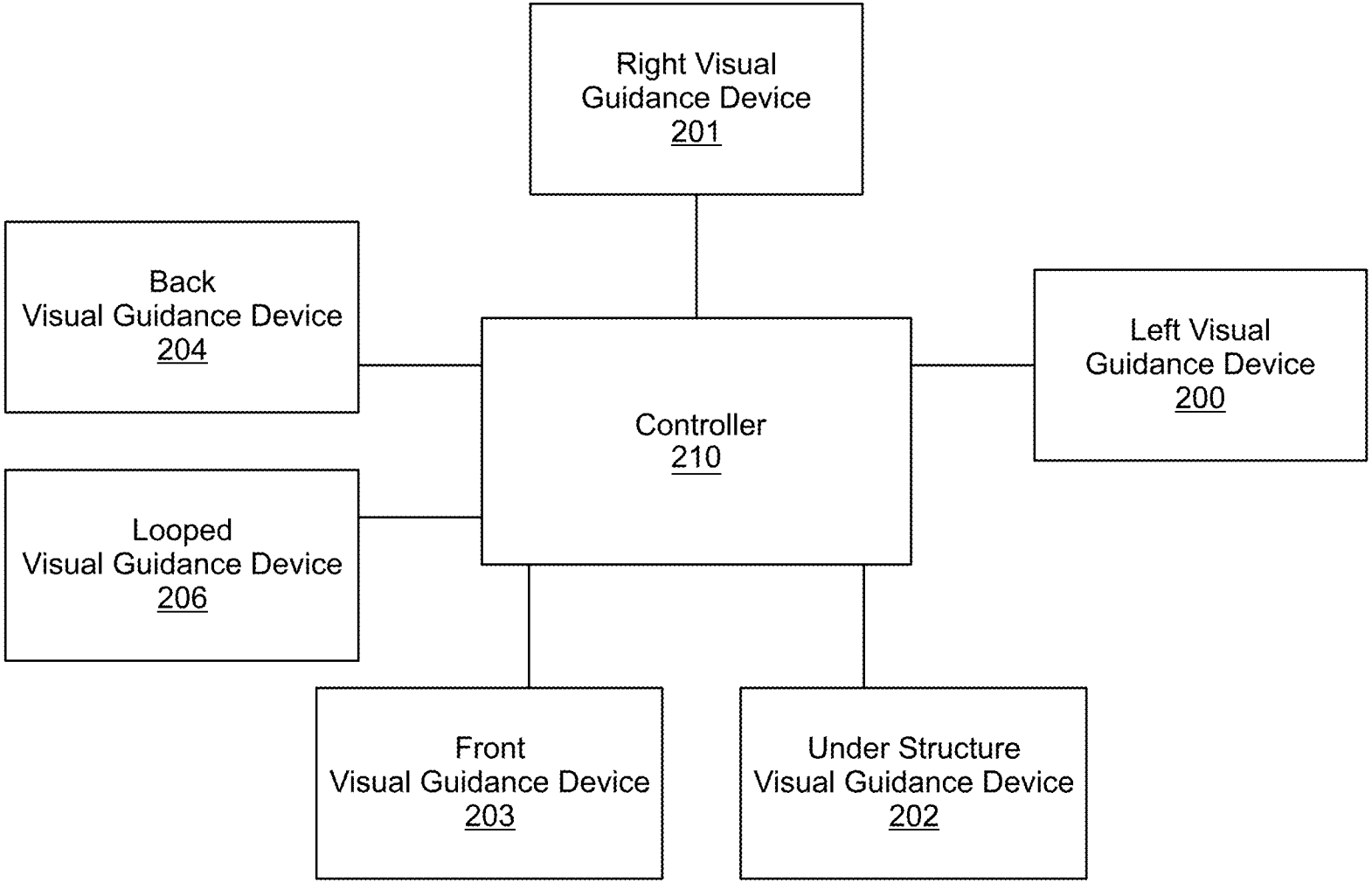
FIG. 17 is a block diagram showing an exemplary controller communicatively interconnected with a plurality of visual guidance devices.

FIG. 17 illustrates an exemplary block diagram showing the connections between a central controller 210 and a plurality of visual guidance devices 200, 201, 202, 203, 204, 206. In the exemplary embodiment shown, it can be seen that a central controller 210 is communicatively connected with a left visual guidance device 200, a right visual guidance device 201, an under structure visual guidance device 202, a front visual guidance device 203, a back visual guidance device 204, and a looped visual guidance device 206.

It should be appreciated that various other controlling configurations may be utilized. For example, multiple controllers 210 may be utilized in some embodiments. For example, each visual guidance device 200, 201, 202, 203, 204, 206 may in some embodiments include its own separate controller 210. In other embodiments, more or less visual guidance devices 200, 201, 202, 203, 204, 206 may be communicatively connected with the controller 210 than is shown in the exemplary embodiment of the figure. The controller 210 may be communicatively connected to the visual guidance devices 200, 201, 202, 203, 204, 206 through a wired connection, a wireless connection, or combinations thereof.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine with visual guidance, suitable methods and materials are described above. All publications, patent applications, patents, and other references mentioned herein are incorporated by reference in their entirety to the extent allowed by applicable law and regulations. The exercise machine with visual guidance may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine with visual guidance, comprising:

a frame having a first rail and a second rail;

a carriage movably positioned upon the first rail and the second rail so as to move along at least a portion of the first rail and the second rail;

a bias member connected between the carriage and the frame so as to induce a resistance force against movement of the carriage;

a first visual guidance device connected to the first rail, wherein the first visual guidance device extends along at least a portion of the first rail, wherein the first visual guidance device displays a first sequential lighting moving in a first direction at a first speed providing guidance to an exerciser when moving the carriage in the first direction; and a second visual guidance device connected to the second rail, wherein the second visual guidance device extends along at least a portion of the second rail, wherein the second visual guidance device displays a second sequential lighting moving in a second direction at a second speed providing guidance to the exerciser when moving the carriage in the second direction;

wherein the first direction is opposite of the second direction.

2. The exercise machine with visual guidance of claim 1, wherein the first visual guidance device is positioned within the first rail so as to emanate light from the first rail.

3. The exercise machine with visual guidance of claim 2, wherein the first rail is comprised of a transparent or semi-transparent material.

4. The exercise machine with visual guidance of claim 1, wherein the first visual guidance device is connected to an upper end of the first rail.

5. The exercise machine with visual guidance of claim 1, wherein the first visual guidance device is selected from the group consisting of a lighting device, an illumination device, a lamp, a light-emitting-diode, a liquid crystal display, a light rope, a projection device, a holographic generator, a fluorescent light, a rope light, and a light strip.

6. The exercise machine with visual guidance of claim 1, wherein the first visual guidance device is comprised of linear lighting.

7. The exercise machine with visual guidance of claim 1, wherein the first visual guidance device is comprised of an elongated display.

8. The exercise machine with visual guidance of claim 1, further comprising a controller for controlling the first visual guidance device and the second visual guidance device.

9. The exercise machine with visual guidance of claim 1, wherein the first visual guidance device and the second visual guidance device are both comprised of a single light device.

10. The exercise machine with visual guidance of claim 1, wherein the first visual guidance device and the second visual guidance device are both comprised of a single rope light device that is looped near one end of the frame.

11. An exercise machine with visual guidance, comprising:

a frame having a first rail and a second rail;

a carriage movably positioned upon the first rail and the second rail so as to move along at least a portion of the first rail and the second rail;

a bias member connected between the carriage and the frame so as to induce a resistance force against movement of the carriage;

a first visual guidance device connected to the first rail, wherein the first visual guidance device extends along at least a portion of the first rail, wherein the first visual guidance device displays a first sequential lighting moving in a first direction at a first speed providing guidance to an exerciser when moving the carriage in the first direction; and a second visual guidance device connected to the second rail, wherein the second visual guidance device extends along at least a portion of the second rail, wherein the second visual guidance device displays a second sequential lighting moving in a second direction at a second speed providing guidance to the exerciser when moving the carriage in the second direction; and wherein the first direction is opposite of the second direction;

wherein the first visual guidance device and the second visual guidance device are comprised of linear lighting; and a controller for controlling the first visual guidance device and the second visual guidance device.

12. The exercise machine with visual guidance of claim 11, wherein the first visual guidance device is positioned within the first rail so as to emanate light from the first rail.

13. The exercise machine with visual guidance of claim 12, wherein the first rail is comprised of a transparent or semi-transparent material.

14. The exercise machine with visual guidance of claim 11, wherein the first visual guidance device is connected to an upper end of the first rail and wherein the second visual guidance device is connected to an upper end of the second rail.

15. The exercise machine with visual guidance of claim 11, wherein the first visual guidance device is selected from the group consisting of a lighting device, an illumination device, a lamp, a light-emitting-diode, a liquid crystal display, a light rope, a projection device, a holographic generator, a fluorescent light, a rope light, and a light strip.

16. The exercise machine with visual guidance of claim 11, wherein the first visual guidance device and the second visual guidance device are both comprised of a single light device.

17. The exercise machine with visual guidance of claim 11, wherein the first visual guidance device and the second visual guidance device are both comprised of a single rope light device that is looped near one end of the frame.

18. An exercise machine with visual guidance, comprising:

a frame having a rail;

a carriage movably positioned upon the rail so as to move along at least a portion of the rail;

a bias member connected between the carriage and the frame so as to induce a resistance force against movement of the carriage;

a first visual guidance device connected to a first side of the rail, wherein the first visual guidance device extends along at least a portion of the rail, wherein the first visual guidance device displays a first sequential lighting moving in a first direction at a first speed providing guidance to an exerciser when moving the carriage in the first direction; and a second visual guidance device connected to a second side of the rail, wherein the second visual guidance device extends along at least a portion of the rail, wherein the second visual guidance device displays a second sequential lighting moving in a second direction at a second speed providing guidance to the exerciser when moving the carriage in the second direction; and wherein the first direction is opposite of the second direction;

wherein the first visual guidance device and the second visual guidance device are comprised of linear lighting; and a controller for controlling the first visual guidance device and the second visual guidance device.

19. The exercise machine with visual guidance of claim 18, wherein the first visual guidance device and the second visual guidance device are connected to an upper end of the rail.

20. The exercise machine with visual guidance of claim 18, wherein the first visual guidance device and the second visual guidance device are both comprised of a single light device.

* * * * *